US010609951B2

(12) United States Patent
Nakano et al.

(10) Patent No.: US 10,609,951 B2
(45) Date of Patent: Apr. 7, 2020

(54) METHOD FOR PRODUCING FLAVOR SOURCE AND PACKAGE

(71) Applicant: JAPAN TOBACCO INC., Tokyo (JP)

(72) Inventors: Takuma Nakano, Tokyo (JP); Keiko Fujii, Tokyo (JP); Kimitaka Uchii, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 144 days.

(21) Appl. No.: 15/493,620

(22) Filed: Apr. 21, 2017

(65) Prior Publication Data

US 2017/0215473 A1 Aug. 3, 2017

Related U.S. Application Data

(63) Continuation of application No. PCT/JP2015/079056, filed on Oct. 14, 2015.

(30) Foreign Application Priority Data

Oct. 24, 2014 (JP) ..... 2014-217772

(51) Int. Cl.
*A24B 15/42* (2006.01)
*A24B 13/00* (2006.01)
(Continued)

(52) U.S. Cl.
CPC ..... *A24B 15/42* (2013.01); *A24B 13/00* (2013.01); *A24B 15/28* (2013.01); *A24B 15/282* (2013.01);
(Continued)

(58) Field of Classification Search
None
See application file for complete search history.

(56) References Cited

U.S. PATENT DOCUMENTS 4,607,646 A * 8/1986 Lilly, Jr. ..... A24B 15/28 131/300
4,922,901 A 5/1990 Brooks et al.
(Continued)

FOREIGN PATENT DOCUMENTS

JP 2-124081 A 5/1990
JP 2-238873 A 9/1990
(Continued)

OTHER PUBLICATIONS

Japanese Office Action, dated Oct. 2, 2018, for Japanese Application No. 2016-555188, along with an English machine translation.
(Continued)

*Primary Examiner* — Michael J Felton
*Assistant Examiner* — Katherine A Will
(74) *Attorney, Agent, or Firm* — Birch, Stewart, Kolasch & Birch, LLP

(57) ABSTRACT

A method for producing a flavor source that supports an inhaling flavor component contained in a tobacco raw material, comprises: step A of performing an alkali treatment on the tobacco raw material; and step B of arranging an alkali-treated tobacco raw material and a flavor base material configured by non-tobacco material within a same space in such a way that the alkali-treated tobacco raw material and the flavor base material are maintained in a non-contacting state, thereby inducing the flavor base material to support the inhaling flavor component emitted as a vapor phase from the tobacco raw material.

11 Claims, 21 Drawing Sheets

(51) Int. Cl.

| | |
|---|---|
| ***A24B 15/28*** | (2006.01) |
| ***A24F 47/00*** | (2020.01) |
| ***A24F 23/02*** | (2006.01) |

(52) U.S. Cl.

CPC ..... *A24F 23/02* (2013.01); *A24F 47/00* (2013.01); *A24F 47/002* (2013.01); *A24F 47/006* (2013.01)

(56) References Cited

U.S. PATENT DOCUMENTS

| | | | | |
|---|---|---|---|---|
| 4,955,399 | A | 9/1990 | Potter et al. | |
| 5,016,654 | A * | 5/1991 | Bernasek ..... | A24B 15/24 131/275 |
| 5,038,802 | A | 8/1991 | White et al. | |
| 2010/0242976 | A1 | 9/2010 | Katayama et al. | |
| 2012/0006342 | A1 | 1/2012 | Rose et al. | |
| 2013/0133675 | A1 | 5/2013 | Shinozaki et al. | |
| 2013/0160779 | A1 | 6/2013 | Chida et al. | |
| 2014/0261482 | A1 | 9/2014 | Fall et al. | |
| 2016/0073678 | A1 | 3/2016 | Fujisawa et al. | |
| 2016/0073680 | A1 | 3/2016 | Rushforth et al. | |
| 2017/0020200 | A1 | 1/2017 | Robinson et al. | |

FOREIGN PATENT DOCUMENTS

| | | | |
|---|---|---|---|
| JP | 2010-506594 | A | 3/2010 |
| JP | 2012-520736 | A | 9/2012 |
| WO | WO 2007/053096 | A1 | 6/2007 |
| WO | WO 2009/069519 | A1 | 6/2009 |
| WO | WO 2012/023515 | A1 | 2/2012 |
| WO | WO 2013/146952 | A1 | 10/2013 |
| WO | WO 2014/170652 | A1 | 10/2014 |
| WO | WO 2014/170653 | A1 | 10/2014 |
| WO | WO 2014/170654 | A1 | 10/2014 |
| WO | WO 2014/170655 | A2 | 10/2014 |
| WO | WO 2014/176399 | A1 | 10/2014 |

OTHER PUBLICATIONS

Japanese Notification of Reasons for Refusal for Japanese Application No. 2016-555188, dated Mar. 6, 2018, with machine translation.

Extended European Search Report for European Application No. 15852047.8, dated Jun. 6, 2018.

International Search Report, issued in PCT/JP2015/079056 (PCT/ISA/210), dated Jan. 12, 2016.

U.S. Office Action, dated Nov. 15, 2019, for U.S. Appl. No. 16/264,291.

* cited by examiner

FIG. 14

| TRANSFER SOURCE RAW MATERIAL | RATE OF INHALING FLAVOR COMPONENT (%) | AMOUNT OF MOISTURE (%) | pH | AMOUNT OF RAW MATERIAL(mg) |
|---|---|---|---|---|
| RAW MATERIAL A | 6.34 | 17.7 | 10.12 | 40 |
| RAW MATERIAL B | 6.34 | 17.7 | 10.12 | 80 |

| FLAVOR BASE MATERIAL | COMPOSITION | WEIGHT OF BASE MATERIAL |
|---|---|---|
| | GUM BASE:SUGAR ALCOHOL=74:26 | 1g |

| TRANSFER CONDITION | SAMPLE | TRANSFER SOURCE RAW MATERIAL | TRANSFER TEMPERATURE | TRANSFER TIME |
|---|---|---|---|---|
| | SAMPLE1 | RAW MATERIAL A | 22°C | 7DAY |
| | SAMPLE2 | RAW MATERIAL A | 40°C | 7DAY |
| | SAMPLE3 | RAW MATERIAL B | | 6DAY |
| | SAMPLE4 | RAW MATERIAL B | | 12DAY |

FIG. 15

| SAMPLE | DISTRIBUTION | AMOUNT OF INHALING FLAVOR COMPONENT(mg) | RATE (%) |
|---|---|---|---|
| SAMPLE1 | OUTER LAYER | 1.25 | 91.85 |
| | INTERNAL PART | 0.11 | 8.15 |
| SAMPLE2 | OUTER LAYER | 1.64 | 90.48 |
| | INTERNAL PART | 0.17 | 9.52 |

FIG. 16

| SAMPLE | DISTRIBUTION | AMOUNT OF INHALING FLAVOR COMPONENT(mg) | RATE (%) |
|---|---|---|---|
| SAMPLE3 | OUTER LAYER | 2.97 | 92.81 |
| | INTERNAL PART | 0.23 | 7.19 |
| SAMPLE4 | OUTER LAYER | 2.96 | 93.58 |
| | INTERNAL PART | 0.20 | 6.42 |

FIG. 17

| TOBACCO RAW MATERIAL | RATE OF INHALING FLAVOR COMPONENT (%) | RATE OF MOISTURE(%) | pH | AMOUNT OF RAW MATERIAL(mg) |
|---|---|---|---|---|
| | 6.49 | 12.8 | 10.07 | 300 |

| FLAVOR BASE MATERIAL | SAMPLE | GLYCERIN(mg) | LEVULINIC ACID(mg) |
|---|---|---|---|
| | SAMPLE11 | 16 | 4 |
| | SAMPLE12 | 20 | 0 |

| TRANSFER CONDITION | TRANSFER TEMPERATURE | TRANSFER TIME | NOTE |
|---|---|---|---|
| | 60℃ | 1DAY | SEALED CONDITION |

| SAMPLE | AMOUNT OF INHALING FLAVOR COMPONENT(mg) | STANDARD DEVIATION(mg) |
|---|---|---|
| SAMPLE11 | 5.53 | 0.15 |
| SAMPLE12 | 2.14 | 0.14 |

FIG. 20

| | RESIDUAL RATIO OF INHALING FLAVOR COMPONENT [–] | RESIDUAL RATIO OF LEVULINIC ACID | A/N RATIO |
|---|---|---|---|
| SAMPLE21 | 0.554 | — | 0 |
| SAMPLE22 | 0.757 | 0.96 | 0.53 |
| SAMPLE23 | 0.884 | 0.66 | 1.16 |
| SAMPLE24 | 0.895 | 0.47 | 3.52 |

FIG. 23

| | RESIDUAL RATIO OF INHALING FLAVOR COMPONENT [–] | ADDITIVE | A/N RATIO |
|---|---|---|---|
| SAMPLE31 | 0.76 | — | 0.53 |
| SAMPLE32 | 0.95 | PROPYLENE GLYCOL(10 WEIGHT %) | 0.50 |
| SAMPLE33 | 1.00 | WATER(10 WEIGHT %) | 0.49 |

FIG. 25

| | RESIDUAL RATIO OF LEVULINIC ACID[-] | ADDITIVE | A/N RATIO |
|---|---|---|---|
| SAMPLE41 | 0.882 | WATER(10 WEIGHT %) | 2.99 |
| SAMPLE42 | 0.598 | — | 2.98 |
| SAMPLE43 | 0.943 | WATER(10 WEIGHT %) | 1.56 |
| SAMPLE44 | 0.629 | — | 1.62 |

FIG. 27

| | RESIDUAL RATIO OF INHALING FLAVOR COMPONENT[–] | RESIDUAL RATIO OF FORMIC ACID[-] | A/N RATIO |
|---|---|---|---|
| SAMPLE51 | 0.96 | 0.87 | 0.60 |
| SAMPLE52 | 0.92 | 0.90 | 0.61 |
| SAMPLE53 | 1.00 | 0.87 | 0.60 |

METHOD FOR PRODUCING FLAVOR SOURCE AND PACKAGE

CROSS REFERENCE TO RELATED APPLICATIONS

This application is a Continuation of PCT International Application No. PCT/JP2015/079056, filed on Oct. 14, 2015, which claims priority under 35 U.S.C. 119(a) to Patent Application No. 2014-217772, filed in Japan on Oct. 24, 2014, all of which are hereby expressly incorporated by reference into the present application.

TECHNICAL FIELD

The present invention relates to a method for producing a flavor source that supports an inhaling flavor component contained in tobacco raw material, and relates to a portable package.

BACKGROUND ART

Techniques for using tobacco raw material per se as a flavor source for use in inhaling flavor products, such as flavor inhalers or oral products, are conventionally known. Alternatively, techniques in which inhaling flavor components extracted from tobacco raw material are supported by a flavor base material, and used as a flavor source are known.

CITATION LIST

Patent Literature

Patent Document 1: Japanese Unexamined Patent Application Publication (Translation of PCT Application) No. 2010-506594

Patent Document 2: WO 2012/023515

SUMMARY

A first feature is summarized as a method for producing a flavor source that supports an inhaling flavor component contained in a tobacco raw material, the method comprising: step A of performing an alkali treatment on the tobacco raw material; and step B of arranging an alkali-treated tobacco raw material and a flavor base material configured by non-tobacco material within a same space in such a way that the alkali-treated tobacco raw material and the flavor base material are maintained in a non-contacting state, thereby inducing the flavor base material to support the inhaling flavor component emitted as a vapor phase from the tobacco raw material.

A second feature is summarized as the method for producing a flavor source according to the first feature, wherein the flavor base material is a member of solid form, or a liquid impregnated into a solid.

A third feature is summarized as the method for producing a flavor source according to the first feature or the second feature, wherein the flavor base material is a capture solvent, and the method includes step E of adding a carboxylic acid to the capture solvent.

A fourth feature is summarized as the method for producing a flavor source according to the third feature, wherein the ratio of a molar quantity of the carboxylic acid added to the capture solvent, relative to a molar quantity of the inhaling flavor component captured by the capture solvent, is greater than 0.5 and less than 1.0.

A fifth feature is summarized as the method for producing a flavor source according to the third feature, wherein a capture solution includes 10 wt % or more of water where the capture solution containing at least the inhaling flavor component, the carboxylic acid and a capture solvent is 100 wt %, in a case where a ratio of the molar quantity of the carboxylic acid added to the capture solvent, relative to the molar quantity of the inhaling flavor component captured by the capture solvent, is 1.0 or more.

A sixth feature is summarized as the method for producing a flavor source according to the fifth feature, wherein the step B includes: heating the alkali-treated tobacco raw material while arranged in the same space, the method includes: step F of adding water to the capture solvent or to the capture solution, in a case where the ratio of the molar quantity of the carboxylic acid added to the capture solvent, relative to the molar quantity of the inhaling flavor component captured by the capture solvent, is 1.0 or more, and the step F is a step of adding water such that the capture solution includes 10 wt % or more of water, where the capture solution is 100 wt %.

A seventh feature is summarized as the method for producing a flavor source according to the third feature, wherein the capture solution includes 10 wt % or more of propylene glycol, 10 wt % or more of water, or a total of 10 wt % or more of a mixed solution of propylene glycol and water where the capture solvent including at least the inhaling flavor component, the carboxylic acid and the capture solvent is 100 wt %, in a case where the ratio of the molar quantity of the carboxylic acid added to the capture solvent, relative to the molar quantity of the inhaling flavor component captured by the capture solvent, is 0.5 or less.

An eighth feature is summarized as the method for producing a flavor source according to the seventh feature, wherein the step B includes: heating the alkali-treated tobacco raw material while arranged in the same space, the method includes a step F of adding propylene glycol, water, or a mixed solution of propylene glycol and water, to the capture solvent or to the capture solution, in a case where the ratio of the molar quantity of the carboxylic acid added to the capture solvent, relative to the molar quantity of the inhaling flavor component captured by the capture solvent, is 0.5 or less, and the step F is a step of adding propylene glycol, water or the mixed solution, such that the capture solution includes 10 wt % or more of propylene glycol, 10 wt % or more of water, or a total of 10 wt % or more of the mixed solution, where the capture solution is 100 wt %.

A ninth feature is summarized as the method for producing a flavor source according to the sixth feature or the eighth feature, wherein the step F is performed after the step B in a case where the capture solvent is heated together with the alkali-treated tobacco raw material in the step B.

A tenth feature is summarized as the method for producing a flavor source according to any one of the first feature to the ninth feature, wherein the step B includes: heating at least the alkali-treated tobacco raw material.

A eleventh feature is summarized as the method for producing a flavor source according to any one of the first feature, the second feature and the tenth feature, wherein the flavor base material is a member of solid form, and the method includes step C of kneading the flavor base material.

A twelfth feature is summarized as the method for producing a flavor source according to the eleventh feature, comprising step D of molding the flavor base material after the step C.

A thirteenth feature is summarized as a portable package comprising: an inhaling flavor product including a flavor base material configured by a non-tobacco material, a tobacco raw material that has undergone an alkali treatment and emits an inhaling flavor component as a vapor phase, and a container portion that contains the tobacco raw material and the flavor base material, wherein the container portion limits a movement of at least one of the tobacco raw material and the flavor base material so as to maintain the tobacco raw material and the flavor base material in a non-contacting state, and the tobacco raw material and the flavor base material are arranged within a same space constructed by the container portion.

A fourteenth feature is summarized as the portable package according to the thirteenth feature, wherein the inhaling flavor product is a flavor inhaler used to inhale the inhaling flavor component, the flavor inhaler includes the flavor base material and a holder configured to hold the flavor base material, and the holder functions as part of the container portion prior to use of the flavor inhaler.

A fifteenth feature is summarized as the portable package according to the thirteenth feature, comprising a case body configured to form a space for containing the tobacco raw material and the inhaling flavor product, wherein the flavor base material is an oral base material for use in the mouth, the inhaling flavor product is an oral product configured by the oral base material itself, and the container portion is configured by the case body.

A sixteenth feature is summarized as the portable package according to the fourteenth feature, wherein the flavor base material is a member containing at least one type of polyhydric alcohol.

A seventeenth feature is summarized as the portable package according to the fifteenth feature, wherein the oral base material is at least one of a gum base, a tablet, a film, and a candy base material.

A eighteenth feature is summarized as the portable package according to the thirteenth feature to seventeenth feature, wherein the same space is a sealed space.

BRIEF DESCRIPTION OF THE DRAWINGS

FIG. 14 is a diagram for describing a first experiment.

FIG. 15 is a diagram for describing the first experiment.

FIG. 16 is a diagram for describing the first experiment.

FIG. 17 is a diagram for describing a second experiment.

FIG. 20 is a diagram for describing a third experiment.

FIG. 23 is a diagram for describing a fourth experiment.

FIG. 25 is a diagram for describing a fifth experiment.

FIG. 27 is a diagram for describing a sixth experiment.

DESCRIPTION OF THE EMBODIMENT

Figure 1:
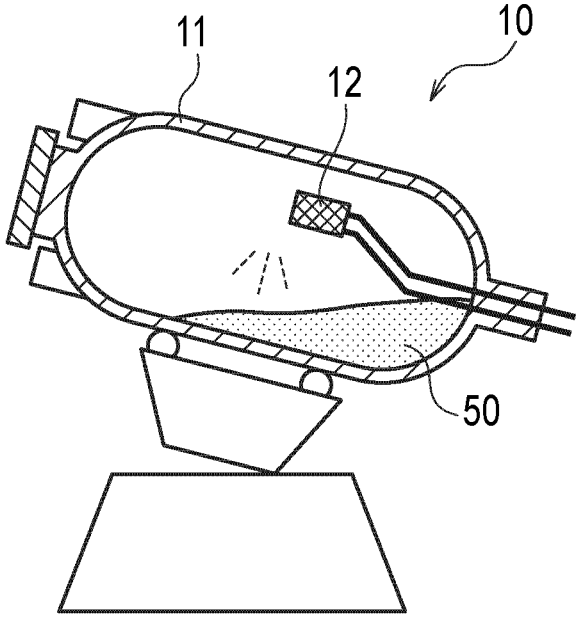
FIG. 1 is a diagram illustrating one example of a producing device according to a first embodiment.

Next, an embodiment will be described. Note that, the same or similar portions are denoted with the same or similar reference signs in the descriptions of the drawings below. Note that, the drawings are schematic and a ratio of each size is different from a real one.

Therefore, specific sizes and the like should be judged in consideration of the following descriptions. Needless to say, portions of which relationship and ratios of mutual sizes are different between the mutual drawings, are included.

Overview of Embodiment

In the above-described technique, the contaminating component contained in the tobacco raw material negatively affects the inhaling flavor, thus it is preferable to remove the contaminating component. Technology to remove the contaminating components has been proposed, however such technology requires complex processes and large scale devices, and it is thus not possible to remove the contaminating components easily and at low cost.

Firstly, a method for producing a flavor source according to the present embodiment is a method for producing a flavor source in which an inhaling flavor component contained in tobacco raw material is supported. This method for producing a flavor source includes (A) performing an alkali treatment on tobacco raw material, and (B) arranging the alkali-treated tobacco raw material and a flavor base material configured by non-tobacco material within the same space in such a way that the alkali-treated tobacco raw material and the flavor base material are maintained in a non-contacting state, thereby inducing the flavor base material to support the inhaling flavor component released as a vapor phase from the tobacco raw material.

In an embodiment, while the tobacco raw material and the flavor base material are in a non-contacting state, the flavor base material is induced to support the inhaling flavor component released as a vapor phase from the tobacco raw material. Therefore, as compared with a case where a flavor base material is induced to support an inhaling flavor component while the tobacco raw material and the flavor base material are in a contacting state, it is possible to induce the flavor base material to induce easily and at low cost the inhaling flavor component contained in the tobacco raw material while preventing transfer of contaminating components.

Secondly, the packaging according to the embodiment is portable. The package includes an inhaling flavor product that has a flavor base material configured by a non-tobacco material, an alkali-treated tobacco raw material that releases an inhaling flavor component as a vapor phase, and a container portion configured to contain the tobacco raw material and the flavor base material. The container portion limits the movement of at least one of the tobacco raw material and the flavor base material so as to maintain the tobacco raw material and the flavor base material in a non-contacting state, and the tobacco raw material and the flavor base material are arranged within the same space configured by the container portion.

In an embodiment, while the tobacco raw material and the flavor base material are arranged within the same space configured by the container portion, movement of at least one of the tobacco raw material and the flavor base material is limited so as to maintain the tobacco raw material and the flavor base material in a non-contacting state. Therefore, it is possible to induce the flavor base material to support easily and at low cost the inhaling flavor component contained in the tobacco raw material, while preventing transfer of contaminating components.

First Embodiment (Producing Device)

Figure 2:
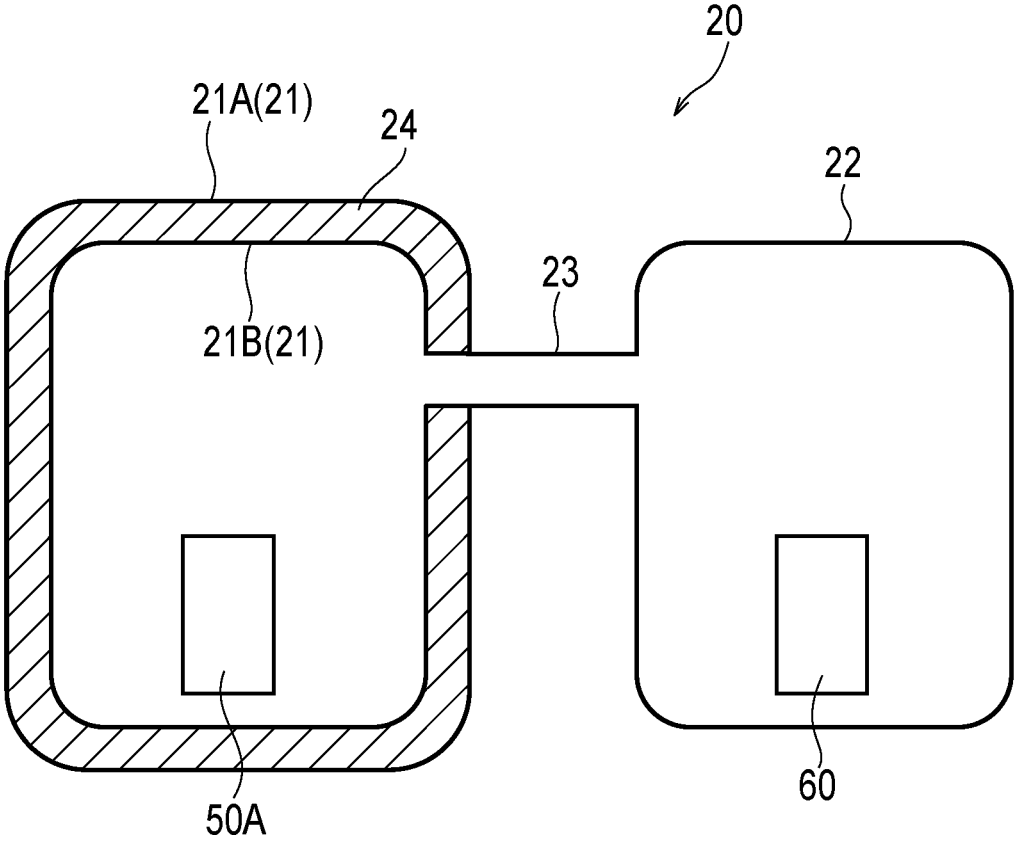
FIG. 2 is a diagram illustrating one example of a producing device according to the first embodiment.

A producing device according to a first embodiment will be described below. FIG. 1 and FIG. 2 are diagrams showing an example of the producing device according to the first embodiment.

Firstly, one example of a treatment device 10 will be described with reference to FIG. 1. The treatment device 10 includes a container 11 and an atomizer 12.

The container 11 contains a tobacco raw material 50. The container 11 is configured, for example, by a member having heat resistance and pressure resistance (e.g., steel used stainless (SUS)). It is preferable that the container 11 configures a sealed space. A "sealed space" refers to a condition in which foreign matter is prevented from infiltrating in the course of normal handling (transport, storage, and the like). In so doing, volatilization of the inhaling flavor component contained in the tobacco raw material 50 out of the container 11 is prevented.

It is noted that as mentioned previously, a nicotine component is one example of an inhaling flavor component that contributes to inhaling flavor, and the use thereof as an index of an inhaling flavor component in an embodiment should be noted.

The atomizer 12 applies an alkali substance to the tobacco raw material 50. As the alkali substance, it is preferable to use, for example, a basic substance, such as an aqueous solution of potassium carbonate.

In this instance, the atomizer 12 preferably applies the alkali substance to the tobacco raw material 50, until the tobacco raw material 50 pH reaches a range of from 8.0 to 14.0, and preferably from 8.5 to 11.0. Further, for efficient release of the inhaling flavor component as a vapor phase from the tobacco raw material 50, the water content in the tobacco raw material 50 after being misted with the alkaline substance is preferably 10 wt % or more, and more preferably 30 wt % or more. There is no particular limit as to the upper limit of the water content in the tobacco raw material 50; however, the water content is preferably 50 wt % or less, in order to efficiently heat the tobacco raw material 50, for example.

It is noted that the initial contained amount of the inhaling flavor component (in this case, the nicotine component) contained in the tobacco raw material 50, in the dry state, is preferably 2.0 wt % or more, where the total weight of the tobacco raw material 50 is 100 wt %. The initial contained amount of the inhaling flavor component (in this case, the nicotine component) is preferably 4.0 wt % or more.

As the tobacco raw material 50, a *Nicotiana* raw material such as *Nicotiana. tabacum* or *Nicotiana. rusutica*, may be used, for example. Varieties such as Burley and flue-cured, for example, may be used as the *Nicotiana. tabacum*. It is noted that varieties besides Burley and flue-cured may also be used as the tobacco raw material 50.

The tobacco raw material 50 may be configured by cut or powder and granular tobacco raw material. In this case, the particle diameter of the cut or powder and granular material is preferably from 0.5 mm to 1.18 mm.

Secondly, one example of a transfer device 20 will be described with reference to FIG. 2. The transfer device 20 includes a container 21, a container 22, and a pipe 23.

The container 21 has an outer case 21A and an inner case 21B. The container 21, configured by the outer case 21A and the inner case 21B, contains the tobacco raw material 50 which has undergone alkali treatment (hereinafter, "tobacco raw material 50A"). Between the inner case 21A and the outer case 21B is formed a flow path through which circulates a heat medium (e.g. steam). The tobacco raw material 50A contained within the container 21 is heated by the heat medium circulating along the flow path formed between the inner case 21A and the outer case 21B.

The container 22 is provided separately from the container 21, and contains the flavor base material 60. The pipe 23 is a cylindrical member, with one end of the pipe 23 opening to the inside of the container 21, and the other end of the pipe 23 opening to the inside of the container 22.

Here, the container 21, the container 22, and the pipe 23 contain the tobacco raw material 50A and the flavor base material 60 in such a way that the tobacco raw material 50A and the flavor base material 60 are maintained in a non-contacting state. It is preferable that the container 21, the container 22, and the pipe 23 configure a sealed space. A "sealed space" refers to a condition in which foreign matter is prevented from infiltrating in the course of normal handling (transport, storage, and the like). In so doing, volatilization of the inhaling flavor component contained in the tobacco raw material 50 to the outside of the sealed space is prevented.

As described above, the heat medium circulating through the flow passage formed between the outer case 21A and the inner case 21B heats the tobacco raw material 50A which is contained in the container 21. While there are no particular limitations as to the conditions for heating the tobacco raw material 50A, a temperature of from 40° C. to less than 150° C. is preferred.

The flavor base material 60 is configured by a non-tobacco material. The flavor base material 60 is preferably a member of solid form, or a liquid impregnated into a solid.

A member of solid form should be a member having a definite shape, but a semi-solid member (a member of gel form) having a given viscosity would also be acceptable. In a case where the flavor base material 60 is a solid member, the flavor base material 60 is at least any one of a gum base, a tablet, a film, or a hard candy base material, for example.

The liquid which has been impregnated into the solid is, for example, a capture solvent that contains an aerosol source such as a polyhydric alcohol (e.g., glycerol). The capture solvent may contain an acidic substance in addition to glycerol. As acidic substances, for example, carboxylic acids such as levulinic acid, malic acid, citric acid, tartaric acid, pyruvic acid, or formic acid may be used. In addition to glycerol and an acidic substance, the capture solvent may contain water or polypropylene glycol. In a case where the flavor base material 60 is a solid impregnated with a liquid, the flavor base material 60 is, for example, a capture solvent impregnated into a filter member (e.g., an acetate filter). However, there is no limitation of embodiment to this arrangement, and the flavor base material 60 may be a capture solvent contained in a cartridge of an electronic cigarette.

(Basic Concept of Method for Producing Flavor Source)

Figure 3:
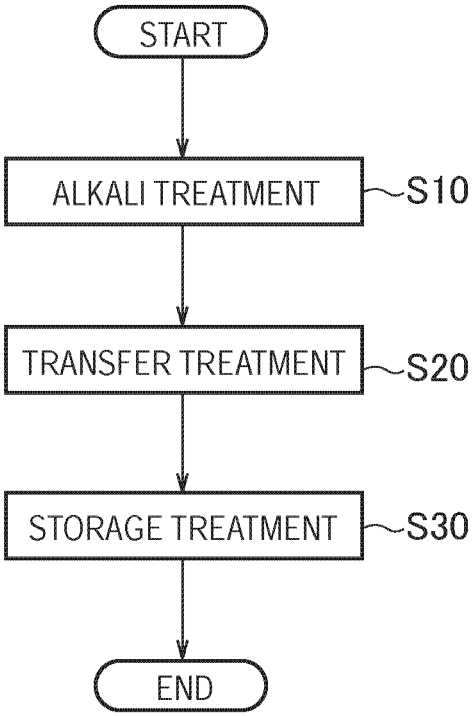
FIG. 3 is a flowchart showing a basic concept of a method for producing a flavor source according to the first embodiment.

A method for producing a flavor source according to the first embodiment will be described below. FIG. 3 is a flowchart showing a basic concept of the method for producing a flavor source according to the first embodiment.

As illustrated in FIG. 3, in step S10 (that is, step A), an alkali substance is applied to the tobacco raw material 50, by using the treatment device 10 mentioned previously. A basic substance, such as a potassium carbonate aqueous solution for example, can be used as the alkali substance.

It is noted that the initial contained amount of the inhaling flavor component (in this case, the nicotine component) contained in the tobacco raw material 50, in the dry state, is preferably 2.0 wt % or more, where the total weight of the tobacco raw material 50 is 100 wt %. The initial contained amount of the inhaling flavor component (in this case, the nicotine component) is preferably 4.0 wt % or more.

The pH of the tobacco raw material 50 subsequent to alkali treatment is within the range of from 8.0 to 14.0, and preferably within the range of from 8.5 to 11.0.

In step S20 (that is, step B), by using the transfer device 20 mentioned previously, the flavor base material 60 is induced to support the inhaling flavor component released as a vapor phase from the alkali-treated tobacco raw material 50 (the tobacco raw material 50A). Here, the tobacco raw material 50A and the flavor base material 60 are arranged within the same space configured by the container 21 and the container 22, so as to maintain the tobacco raw material 50A and the flavor base material 60 in a non-contacting state. It is preferable that the same space configured by the container 21 and the container 22 is a sealed space.

Here, it is preferable that step S20 includes a step of heating the alkali-treated tobacco raw material 50 (the tobacco raw material 50A). While there are no particular limitations as to the heating conditions of the tobacco raw material 50A, as mentioned previously, a temperature of from 40° C. to less than 150° C. is preferred. However, it should be noted that it would be acceptable to not carry out heating of the tobacco raw material 50A.

In step S30, the flavor base material 60 may be stored. Storage of the flavor base material 60 may be performed in a sealed space, or performed in an open space. Further, storage of the flavor base material 60 may be performed in a sealed space, and subsequently performed in an open space. The flavor base material 60 is stored in a state in which the tobacco raw material 50A is not present in the same space therewith. Conceivably, storage may take place in the course of the product distribution process, or during storage at a production facility or retail outlet.

(First Example of Method for Producing Flavor Source)

Figure 4:
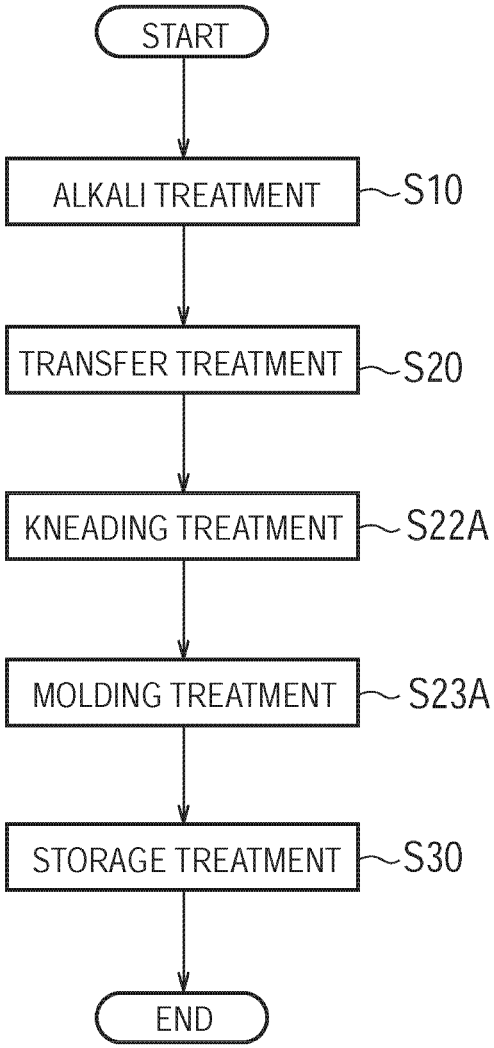
FIG. 4 is a flowchart showing a first example of a method for producing a flavor source according to the first embodiment.

A first example of method for producing a flavor source according to the first embodiment will be described below. FIG. 4 is a flowchart showing a first example of the method for producing a flavor source according to the first embodiment. It is noted that in FIG. 4, like step numbers have been assigned to like processes in FIG. 3. However, it should be noted that the flowchart shown in FIG. 4 is an option of the flowchart shown in FIG. 3, and is not an essential flowchart.

The first example applies to a case where the flavor base material 60 is a member of solid form. That is, the flavor base material 60 is at least any one of a gum base, a tablet, a film, or a hard candy base material, for example.

As shown in FIG. 4, in the first example, step S22A to step S23A have been added to the flowchart shown in FIG. 3.

In step S22A (that is, step C), the flavor base material 60 is kneaded. Specifically, the flavor base material 60 is kneaded in such a way that the interior of the flavor base material 60 changes position with the surface layer portion of the flavor base material 60. In so doing, the inhaling flavor component that has migrated to the surface layer portion of the flavor base material 60 becomes confined within the interior of the flavor base material 60, thereby preventing volatilization of the inhaling flavor component that has transferred to the surface layer portion of the flavor base material 60. The kneading process (step S22A) may be performed in an open space, for ease of handing. However, the kneading process (step S22A) may be performed in the sealed space in the same manner as step S20.

In step S23A (that is, step D), the flavor base material 60 is molded. It should be noted that step 23A (the molding step) is performed after step 22A (the kneading process).

It is noted that in the first example, the transfer step (step S20) may include a step of heating the alkali-treated tobacco raw material 50 (the tobacco raw material 50A).

(Second Example of Method for Producing Flavor Source)

Figure 5:
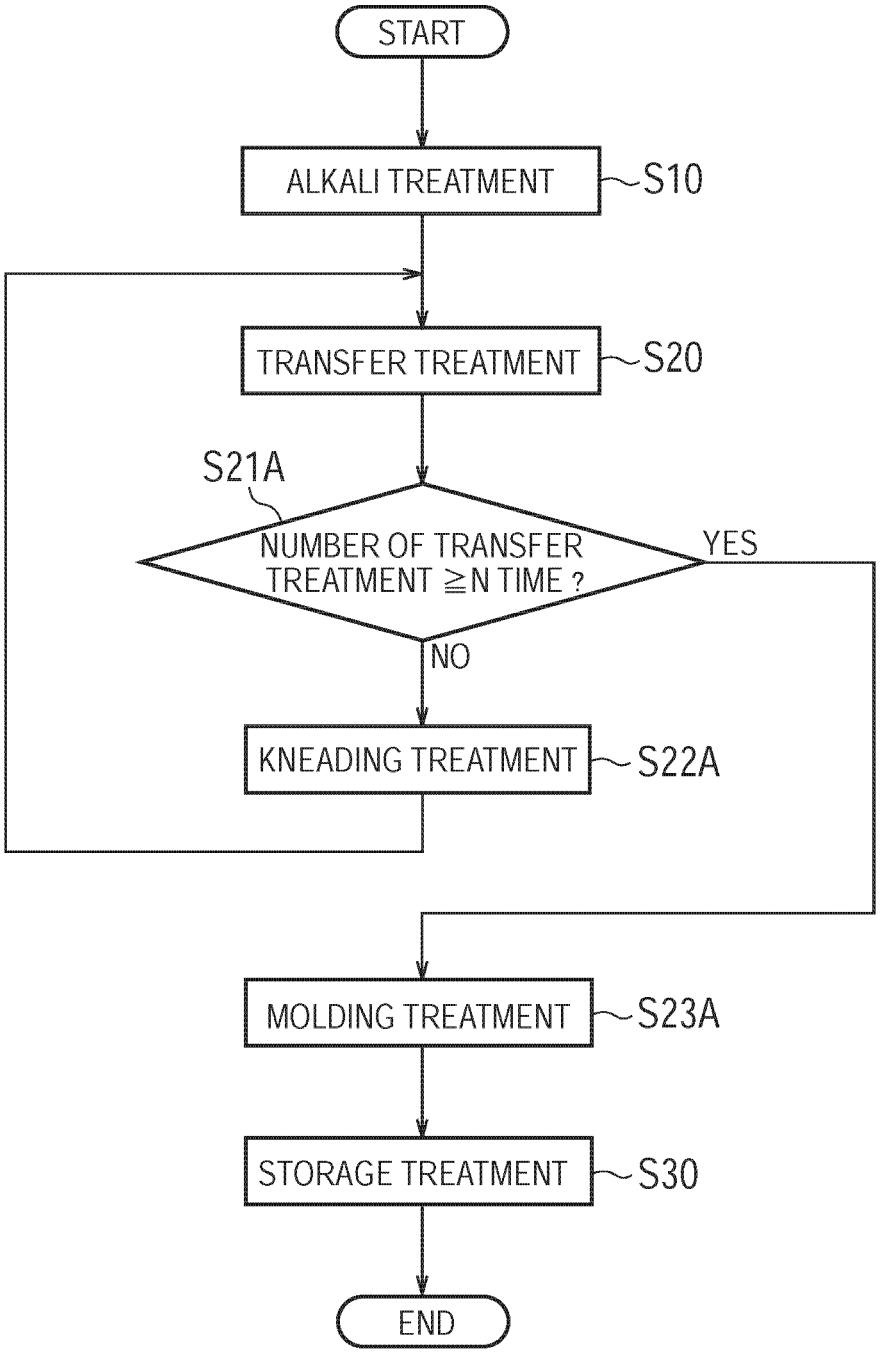
FIG. 5 is a flowchart showing a second example of a method for producing a flavor source according to the first embodiment.

A second example of the method for producing a flavor source according to the first embodiment will be described below. FIG. 5 is a flowchart showing the second example of the method for producing a flavor source according to the first embodiment. It is noted that in FIG. 5, like step numbers have been assigned to like processes in FIG. 3 and FIG. 4. However, it should be noted that the flowchart shown in FIG. 5 is an option of the flowchart shown in FIG. 4, and is not an essential flowchart.

The second example, like the first example, applies to a case where the flavor base material 60 is a member of solid form. That is, the flavor base material 60 is at least any one of a gum base, a tablet, a film, or a hard candy base material, for example.

As shown in FIG. 5, in the second example, step S21A has been added to the flowchart shown in FIG. 4.

In step S21A, a determination is made as to whether the number of transfer processes has reached N iterations or more. N is an integer equal to 2 or more. When the determination result is YES, a process of step S22C is performed. When the determination result is NO, a process of step S22A is performed.

Here, it should be noted that in the flowchart shown in FIG. 5, because N is equal to 2 or more, at least two iterations of the transfer process (step S20) are performed. Further, it should be noted that when performing the transfer process (step S20) subsequent to the kneading process (step S22A) is designated as one cycle, the cycle is performed at least once. In so doing, in addition to preventing volatilization of the inhaling flavor component that has migrated to the surface layer portion of the flavor base material 60, the transfer process (S20) is performed in a state in which the concentration of the inhaling flavor component contained in the surface layer portion of the flavor base material 60 has been lowered due to the kneading process (step S22A), and therefore the desired amount of the inhaling flavor component can rapidly migrate from the tobacco raw material 50A to the flavor base material 60.

It should be noted that in the second example, because N is equal to 2 or more, step S23A (the molding process) is performed after step S22A (the kneading process).

Further, in the second example, the transfer step (step S20) may include a step of heating the alkali-treated tobacco raw material 50 (the tobacco raw material 50A).

(Third Example of Method for Producing Flavor Source)

Figure 6:
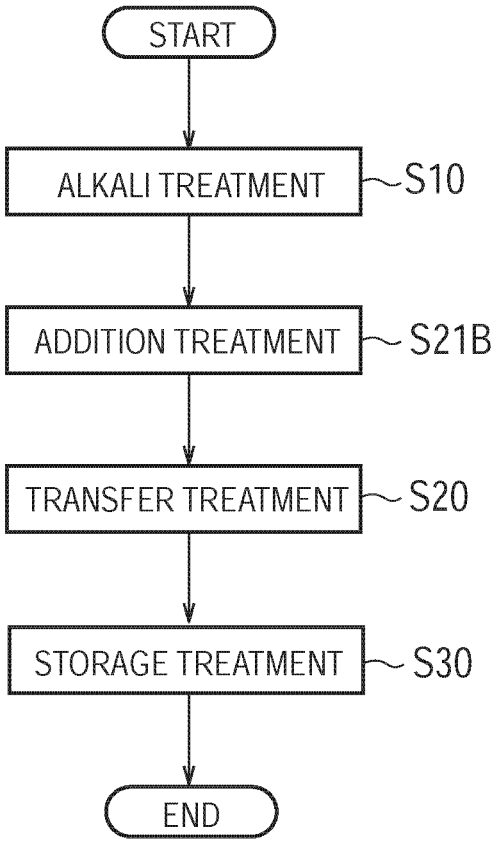
FIG. 6 is a flowchart showing a third example of a method for producing a flavor source according to the first embodiment.

A third example of the method for producing a flavor source according to the first embodiment will be described below. FIG. 6 is a flowchart showing a third example of the method for producing a flavor source according to the first embodiment. It is noted that in FIG. 6, like step numbers have been assigned to like processes in FIG. 3. However, it should be noted that the flowchart shown in FIG. 6 is an option of the flowchart shown in FIG. 3, and is not an essential flowchart.

The third example applies to a case where the flavor base material 60 is a capture solvent. That is, the flavor base material 60 is, for example, a capture solvent impregnated into a filter member (e.g., an acetate filter). However, there is no limitation of embodiment to this arrangement, and the flavor base material 60 may be a capture solvent contained in a cartridge of an electronic cigarette. The capture solvent is, for example, an aerosol source such as a polyhydric alcohol (e.g., glycerol).

As shown in FIG. 6, in the third example, step 21B is added to the flowchart shown in FIG. 3.

In step S21B (that is, step E and step F), an addition process is performed. The addition process may be performed before step S20 (the transfer step), or performed before step S10 (alkali treatment).

It is noted that in the third example, the transfer step (step S20) includes a step of heating the alkali-treated tobacco raw material 50 (the tobacco raw material 50A). Further, in the third example, it is preferable to use the transfer device 20 mentioned previously, and it is preferable to not heat the capture solvent.

In step S21B (the addition step), an additive is added to the capture solvent. The additive is, for example, an acidic substance, and carboxylic acids such as levulinic acid, malic acid, citric acid, tartaric acid, pyruvic acid, or formic acid may be used as the acidic substance, for example. That is, step S21B (the addition step) includes a step (step E) of adding a carboxylic acid to the capture solvent.

Here, the added amount of the acidic substance (carboxylic acid) preferably satisfies the following condition. Specifically, the condition is that which the ratio of the molar quantity of the acidic substance (carboxylic acid) added to the capture solvent, relative to the molar quantity of the inhaling flavor component (here, a nicotine component) captured by the capture solvent (hereinafter denoted as "A/N ratio") is greater than 0.5, and less than 1.0. Here, it should be noted that the lower limit and the upper limit of the A/N ratio includes error of about 0.03. That is, the A/N ratio is preferably greater than any value (lower limit value) within the range from 0.47 to 0.53, and preferably smaller than any value (upper limit value) within the range from 0.97 to 1.03.

Further, it is preferable that in a case where the A/N ratio is 0.5 or less, step S21B (the addition process) includes a step (step F) of adding to a capture solvent propylene glycol, water, or a mixed solution of propylene glycol and water. Specifically, this step is preferably a step of adding to the capture solvent or a capture solution 10 wt % or more of propylene glycol or 10 wt % or more of water, or a total of 10 wt % or more of a mixed solution, where the capture solution containing at least the inhaling flavor component, the carboxylic acid, and the capture solvent is 100 wt %. Here, while there is no particular upper limit as to the added amount of the propylene glycol and the water, or the added amount of the mixed solution, the limit is preferably 80 wt %, and more preferably 50 wt %. It is noted that the additives may include the carboxylic acids mentioned above, in addition to propylene glycol, water, or a mixed solution.

In this way, in a case where the inhaling flavor component (e.g., a nicotine component) is greater in amount than the carboxylic acid, by adding at least one of propylene glycol and water, the residual ratio of the inhaling flavor component residual ratio can be improved, as shown in a fourth experiment described below.

On the other hand, in a case where the A/N ratio is 1.0 or more, step S21B (the addition process) preferably includes a step (step F) of adding water to the capture solvent. Specifically, this step is preferably a step of adding 10 wt % or more of water to the capture solvent or the capture solution, where the capture solution containing at least the inhaling flavor component, the carboxylic acid, and the capture solvent is 100 wt %. Here, while there is no particular upper limit as to the added amount of water, the limit is preferably 80 wt %, and more preferably 50 wt %. It is noted that the additives may include the carboxylic acids mentioned above, in addition to propylene glycol, water, or a mixed solution.

In this way, in a case where the inhaling flavor component (here, a nicotine component) is greater in amount than the carboxylic acid, that is, a case where there is a tendency for esterification of the carboxylic acid to occur by a reaction of the carboxylic acid and glycerol, by adding water, esterification of the carboxylic acid due to a reaction of the carboxylic acid and glycerol is prevented. Therefore, formation of unwanted esters in association with esterification of the carboxylic acid is prevented.

(Operation and Effect)

In the first embodiment while the tobacco raw material 50 and the flavor base material 60 are in a non-contacting state, the flavor base material 60 is induced to support the inhaling flavor component emitted as a vapor phase from the tobacco raw material 50. Therefore, as compared to a case where the flavor base material 60 is induced to support the inhaling flavor component while the tobacco raw material and the flavor base material are in a contacting state, it is possible to induce the flavor base material 60 to support easily and a low cost the inhaling flavor component contained in the tobacco raw material 50, while preventing transfer of contaminating components.

[First Modification]

A first modification of the first embodiment will be described below. Description proceeds with a focus on a difference from the first embodiment, below. The first modification is a modification of the third example of the method for producing a flavor source described above (that is, a case where the flavor base material 60 is a capture solvent).

Figure 7:
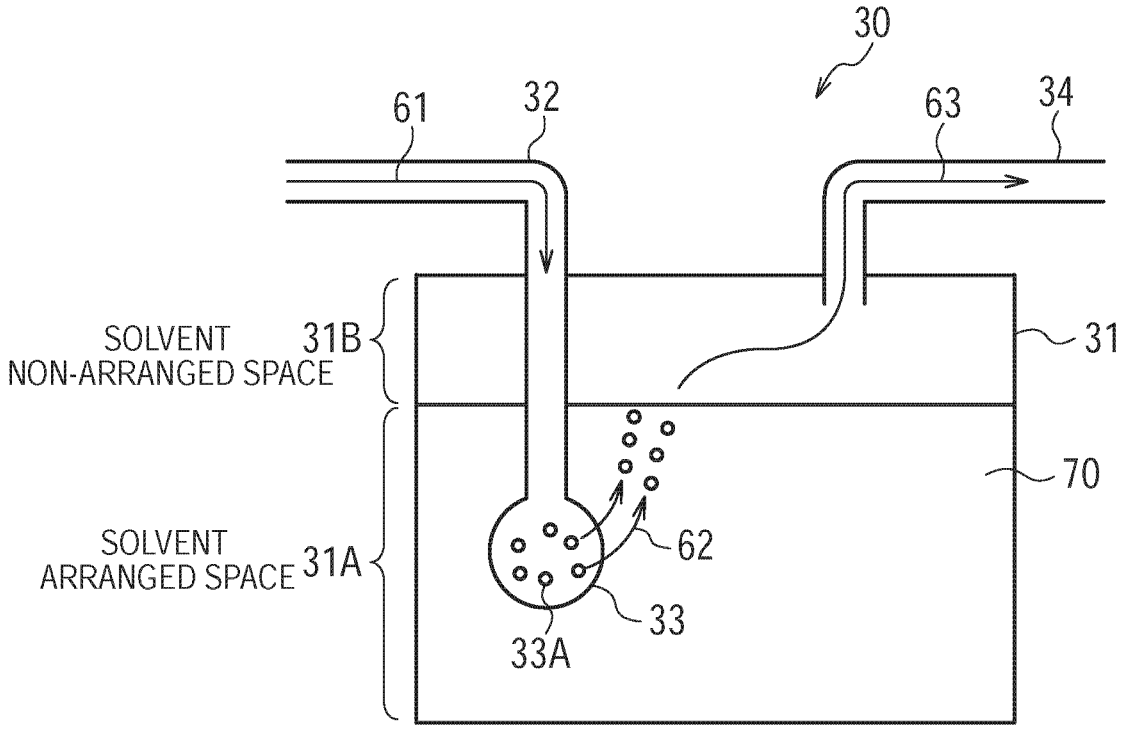
FIG. 7 is a diagram illustrating one example of a producing device according to a modification 1.

Specifically, in the first embodiment, a schematic transfer device 20 is shown as an example of the device configured to perform the transfer process (step S20). In contrast to this, in the first modification, the treatment device 10 shown in FIG. 1 and the capture device 30 shown in FIG. 7 are used as devices configured to perform the transfer step (step S20). In a case where the alkali-treated tobacco raw material 50A is heated, the tobacco raw material 50A, together with the container 11, can be heated while the tobacco raw material 50A is contained in the container 11 of the treatment device 10.

As shown in FIG. 7, the capture device 30 has a container 31, a pipe 32, an emission part 33, and a pipe 34.

The container 31 contains a capture solvent 70 (that is, the flavor base material 60). The container 31 is configured by a member that is resistant to the capture solvent and to volatile inhaling flavor components or volatile contaminants (e.g., glass or stainless steel (SUS)). It is preferable that the container 31 configures a space that is airtight to the extent that it is possible to prevent movement of air to outside the space.

The temperature of the capture solvent 70 is normal temperature, for example. Here, the lower limit for normal temperature is, for example, a temperature at which the capture solvent 70 does not solidify, preferably 10° C. The upper limit of normal temperature is 40° C. or less, for example. By setting the temperature of the capture solvent 70 to from 10° C. to 40° C., it is possible to effectively remove volatile contaminating components, such as ammonium ions or pyridine, while preventing the volatilization of the inhaling flavor component from the capture solution. It is noted that in order to bring the temperature of the capture solvent from 70 to 10° C. to 40° C., the temperature of the container 31 may be chilled to a temperature below normal temperature (e.g. 5° C.).

Glycerol, water, or ethanol can be used as the capture solvent 70, for example. As in the first embodiment, an acidic substance may be added to the capture solvent 70. As acidic substances, for example, carboxylic acids such as levulinic acid, malic acid, citric acid, tartaric acid, pyruvic acid, or formic acid may be used.

The pipe 32 communicates with the container 11 of the treatment device 10 illustrated in FIG. 1. The pipe 32 guides an emitted component 61, which has been emitted as a vapor phase from the tobacco raw material 50 through heating of the tobacco raw material 50, to the capture solvent 70.

The emission part 33 is arranged at the distal end of the pipe 32, and is submerged in the capture solvent 70. The emission part 33 has a plurality of openings 33A. The emission section 61, guided by the pipe 32, emits bubbles of an emitted component 62 into the capture solvent 70 from the plurality of openings 33A.

The pipe 34 guides a residual component 63, which has not been captured by the capture solvent 70, out from the container 31.

In the first modification, the container 31 mentioned above is divided by the interface of the capture solvent 70 into a solvent arranged space 31A in which the capture solvent 70 is arranged, and a solvent non-arranged space 31B in which the capture solvent 70 is not arranged. The emission part 33 arranged at the distal end of the pipe 32 is arranged within the solvent arranged space 31A. That is, the tobacco raw material 50 and the capture solvent 70 are arranged within the same space, configured by the container 11 illustrated in FIG. 1, or the solvent arranged space 31A, the pipe 32 which communicates with the container 11 and the solvent arranged space 31A, and the emission part 33, which are illustrated in FIG. 7. The same space according to the first modification is a sealed space in the sense that volatilization of the emitted component 61 emitted as a vapor phase from the tobacco raw material 50 is prevented in a stage preceding contact of the emitted component 61 with the capture solvent 70.

Here, because the emitted component 62 is a component that is emitted as vapor phase by heating the tobacco raw material 50, it is likely that the temperature of capture solvent 70 rises due to the emitted component 62. Therefore, the capture device 30 may have a function of chilling the capture solvent 70 in order to maintain the temperature of the capture solvent 70 at normal temperature.

The capture device 30 may have a Raschig ring in order to increase the contact area of the emitted component 62 with the capture solvent 70.

Here, in a case where the ratio of the molar quantity of the carboxylic acid added to the capture solvent, relative to the molar quantity of the inhaling flavor component (here, a nicotine component) captured by the capture solvent, is 1.0 or more, it is preferable for the capture solution to contain 10 wt % or more of water, where the capture solution containing at least the inhaling flavor component, the carboxylic acid, and the capture solvent is equal to 100 wt %. The capture solution should contain 10 wt % or more of water, at least prior to step S30 (the storage process). Further, it is preferable that the capture solution is maintained in a state of containing 10 wt % or more of water from the time of the transfer process (step S20) to that of step S30 (the storage process). While there is no particular upper limit as to the amount of water contained in the capture solution, 80 wt % or less is preferred.

It would be acceptable, for example, to use water, or to use water to which a carboxylic acid has been added, as the capture solvent used in the transfer process (step S20). In such a case, it would be acceptable to further add glycerol to the capture solvent. In a case where step S30 (the storage process) is performed, it is acceptable for the timing for addition of the glycerol to precede step S30 (the storage process). In a case where the capture solvent is heated in the transfer process (step S20), from the standpoint of preventing volatilization or denaturation of the glycerol, it is preferable for the timing of addition of the glycerol to follow the transfer step (step S20). It is noted that as mentioned above, it is preferable for the capture solution to contain 10 wt % or more of water following addition of the glycerol.

Further, in a case where the ratio of the molar quantity of the carboxylic acid added to the capture solvent, relative to the molar quantity of the inhaling flavor component (here, a nicotine component) captured by the capture solvent, is 0.5 or less, it is preferable for the capture solution to contain 10 wt % or more of propylene glycol, 10 wt % or more of water, or a total of 10 wt % or more of a mixed solution of propylene glycol and water, where the capture solution containing at least the inhaling flavor component, the carboxylic acid, and the capture solvent is equal to 100 wt %. It is acceptable for the capture solution to contain 10 wt % or more of propylene glycol, water, or a mixed solution, at least prior to step S30 (the storage process). Further, it is preferable that the capture solution is maintained in a state of containing 10 wt % or more of propylene glycol, water, or a mixed solution, from the time of the transfer process (step S20) to that of step S30 (the storage process). While there is no particular upper limit as to the amount of propylene glycol, water, or mixed solution contained in the capture solution, 80 wt % or less is preferred.

Second Embodiment (First Example of Package)

Figure 8:
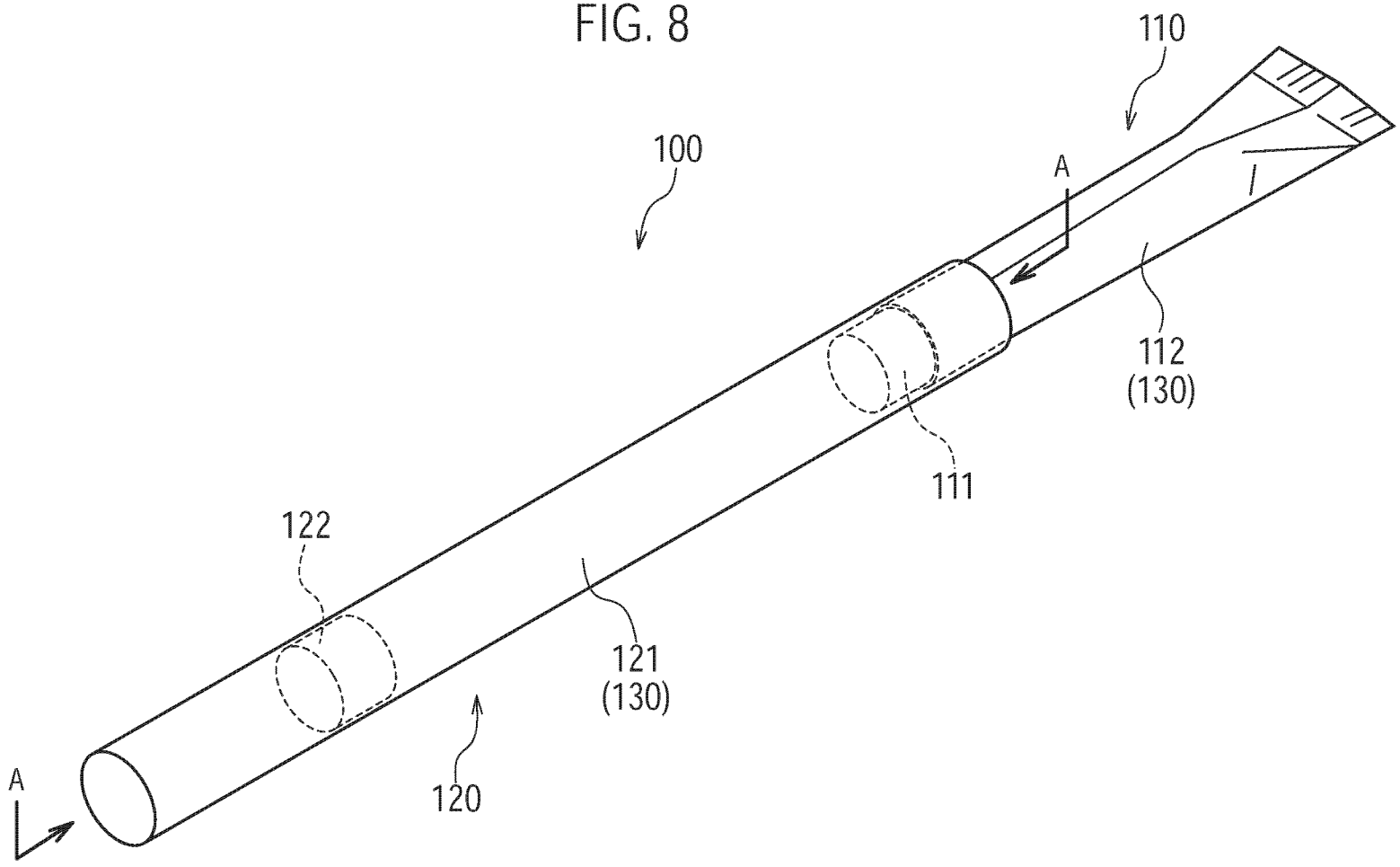
FIG. 8 is a diagram for describing a first example of package according to a second embodiment.
Figure 9:
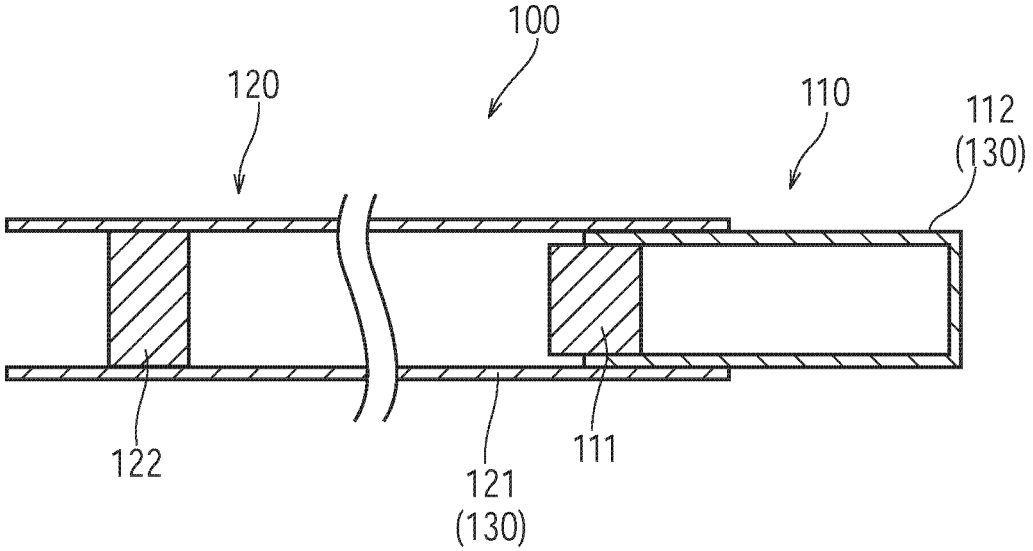
FIG. 9 is a diagram for describing the first example of the package according to the second embodiment.
Figure 10:
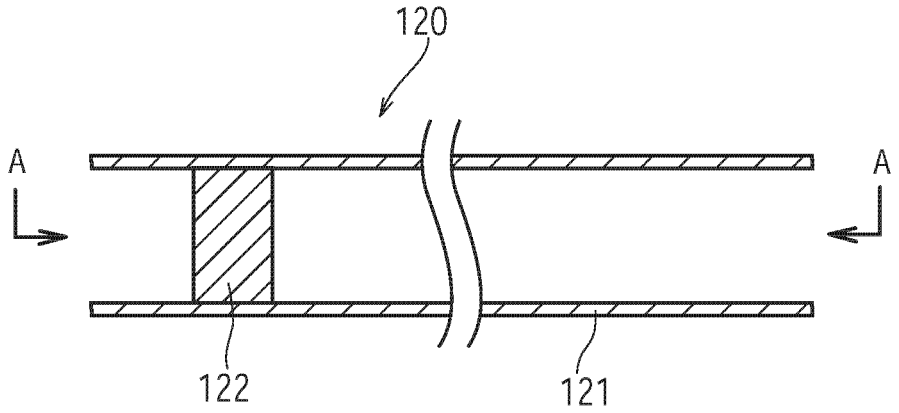
FIG. 10 is a diagram for describing the first example of the packaging according to the second embodiment.

A first example of a package according to a second embodiment will be described below. FIG. 8 to FIG. 10 are diagrams describing a package 100 according to the second embodiment.

As illustrated in FIG. 8, the package 100 is portable. The package 100 has a delivery member 110 and an inhaling flavor product 120.

The delivery member 110 has a tobacco raw material 111 and a wrapping member 112. The tobacco raw material 111 has undergone an alkali treatment, and emits an inhaling flavor component as a vapor phase. The tobacco raw material 111 is wrapped at least in part by the wrapping member 112.

The inhaling flavor product 120 is a flavor inhaler used to inhale the inhaling flavor component. The inhaling flavor product 120 has a holder 121 and a flavor base material 122. The holder 121 is, for example, a paper tube having a cylindrical shape, and retains the flavor base material 122. Further, the tobacco raw material 111 of the delivery member 110 is inserted into the holder 121. The flavor base material 122 is an acetate filter, for example. The flavor base material 122 is a member containing at least one type of polyhydric alcohol. The polyhydric alcohol is glycerol, propylene glycol, or the like, for example. The flavor base material 122 captures the inhaling flavor component emitted as a vapor phase from the tobacco raw material 111.

In the first example of the package, the wrapping member 112 and the holder 121 configure a container portion 130 configured to contain the tobacco raw material 111 and the flavor base material 122. The container portion 130 limits the movement of at least one of the tobacco raw material 111 and the flavor base material 122 so as to maintain the tobacco raw material 111 and the flavor base material 122 in a non-contacting state. The tobacco raw material 111 and the flavor base material 122 are arranged within the same space configured by the container portion 130 (the wrapping member 112 and the holder 121).

Specifically, as illustrated in FIG. 9, the tobacco raw material 111 retained by the wrapping member 112 is inserted into the holder 121, and is exposed within an inside space of the holder 121. Because the tobacco raw material 111 is retained by the wrapping member 112, and the flavor base material 122 is retained by the holder 121, the tobacco raw material 111 and the flavor base material 122 are maintained in a non-contacting state.

Here, it is preferable that the same space configured by the wrapping member 112 and the holder 121 is a sealed space. A "sealed space" refers to a condition in which foreign matter is prevented from infiltrating in the course of normal handling (transport, storage, and the like). For example, one end of the holder 121 is closed off by the delivery member 110, and the other end of the holder 121 is sealed by a seal member. In so doing, the inhaling flavor component contained in the tobacco raw material 111 is largely prevented from volatilization to the outside of the container portion 130 (the wrapping member 112 and the holder 121).

It should be noted that in the first example of the package, during use of the inhaling flavor product 120 (the flavor inhaler), the delivery member 110 is detached from the inhaling flavor product 120 as illustrated in FIG. 10 (the A-A cross section shown in FIG. 8). That is, it should be noted that whereas prior to use of the inhaling flavor product 120 (the flavor inhaler), the holder 121 functions as part of the container portion 130, during use of the inhaling flavor product 120 (the flavor inhaler), it does not function as part of the container portion 130.

While there is no particular limitation thereto, in the first example of the package, the inhaling flavor product 120 may be a burning type flavor inhaler including a carbon heat source configured to entail burning or the like, or a non-burning type flavor inhaler including an atomizer or the like configured to generate an aerosol, without burning.

In the first example of the package, as with the tobacco raw material 50, a *Nicotiana* raw material such as *Nicotiana. tabacum* or *Nicotiana. rusutica*, for example may be used as the tobacco raw material 111. Varieties such as Burley and flue-cured, for example, may be used as the *Nicotiana. tabacum*. It is noted that varieties other than Burley and flue-cured varieties can also be used as the tobacco raw material 111.

The tobacco raw material 111 may be configured by cut or powder and granular tobacco raw material. In this case, the particle diameter of the cut or powder and granular material is preferably 1.18 mm or less, so as to enlarge the specific surface area. Still more preferably, the particle diameter of the cut or powder and granular material is 0.5 mm or less. While there is no particular limitation as to the lower limit of the particle diameter of the cut or powder and granular material, a value of 0.212 mm or more is preferred.

It is noted that the initial content, in the dry state, of the inhaling flavor component (here, a nicotine component) contained in the tobacco raw material 111 is preferably 2.0 wt % or more, where the total weight of the tobacco raw material 111 is 100 wt %. The initial contained amount of the inhaling flavor component (in this case, the nicotine component) is preferably 4.0 wt % or more.

As mentioned above, it is preferable that the pH of the tobacco raw material 111 after the alkali treatment is 8.0 or more. Still more preferably, the pH of the tobacco raw material 111 after the alkali treatment is within the range from 8.0 to 14.0, and more preferably from 8.5 to 11.0.

(Second Example of Package)

Figure 11:
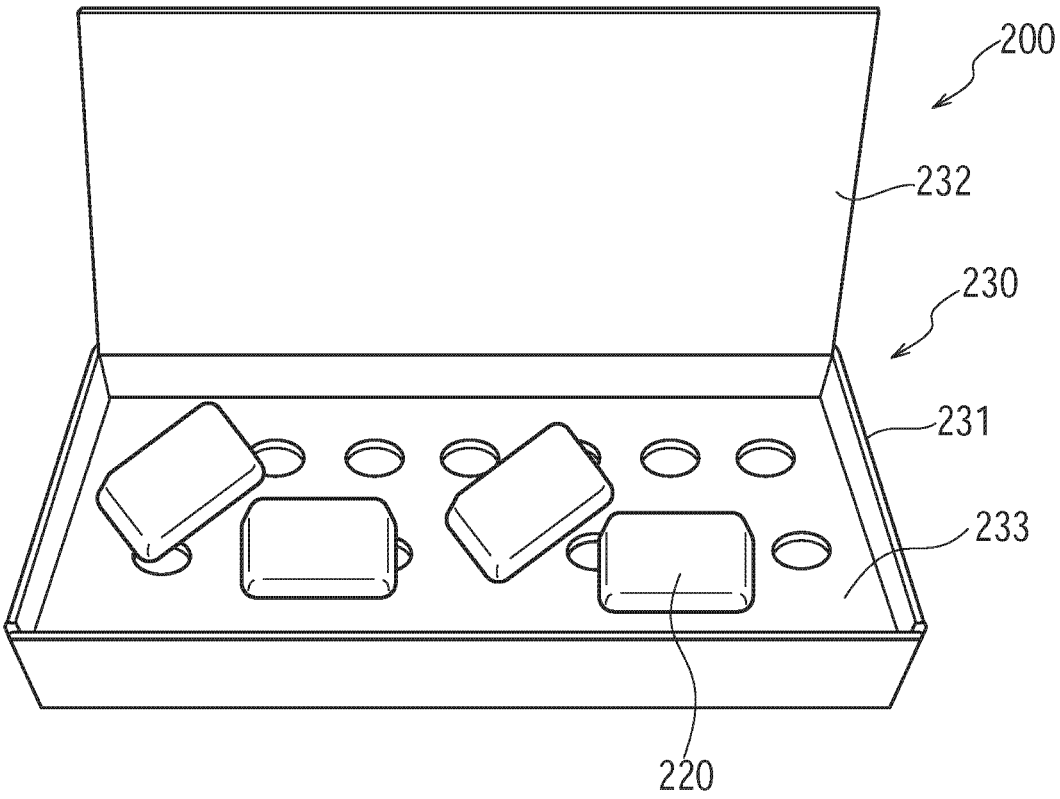
FIG. 11 is a diagram for describing a second example of the packaging according to the second embodiment.
Figure 12:
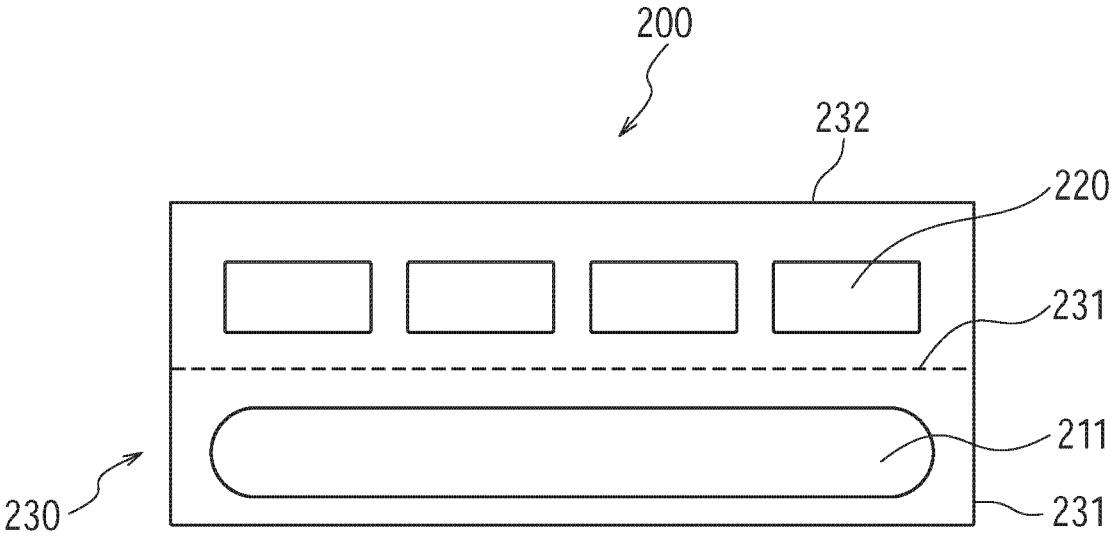
FIG. 12 is a diagram for describing the second example of the packaging according to the second embodiment.

A second example of a package according to the second embodiment will be described below. FIG. 11 to FIG. 12 are diagrams describing a package 200 according to the second embodiment.

As illustrated in FIG. 11 and FIG. 12, the package 200 is portable. The package 200 includes an inhaling flavor product 220, and a case body 230.

The inhaling flavor product 220 is a product for oral use, configured per se by a base material for oral use intended for use in the mouth. The base material for oral use is one example of a flavor base material configured by a non-tobacco material. The inhaling flavor product 220 is at least any one of a gum base, a tablet, a film, or a hard candy base material, for example.

The case body 230 is an example of a container portion configured to form a space for containing the tobacco raw material 211 and the inhaling flavor product 220. The case body 230 has a main body 231, a lid body 232, and a partition plate 233.

The main body 231 has a boxy shape. The lid body 232 is reclosably attached to the main body 231. The main body 231 and the lid body 232 form a space which, with the lid body 232 in the closed state, contains the tobacco raw material 211 and the inhaling flavor product 220. The partition plate 233 divides the space formed by the main body 231 and the lid body 232 into a space for containing the tobacco raw material 211, and a space for containing the inhaling flavor product 220. The partition plate 233 has holes so that the inhaling flavor component emitted as a vapor phase from the tobacco raw material 211 may flow from the space containing the tobacco raw material 211 to the space containing the inhaling flavor product 220. It is preferable that the partition plate 233 has a plurality of holes.

That is, the case body 230 is designed such that movement of at least one of the tobacco raw material 211 and the inhaling flavor product 220 is limited by the partition plate 233, so as to maintain the tobacco raw material 211 and the inhaling flavor product 220 in a non-contacting state. The tobacco raw material 211 and the inhaling flavor product 220 are arranged within the same space configured by the case body 230 (the main body 231 and the lid body 232). It is preferable that the same space is a sealed space. A "sealed space" refers to a condition in which foreign matter is prevented from infiltrating in the course of normal handling (transport, storage, and the like). In so doing, the inhaling flavor component contained in the tobacco raw material 211 is largely prevented from volatilization to the outside of the case body 230.

In the second example of the package, the tobacco raw material 211, like the tobacco raw material 111, has undergone an alkali treatment, and emits an inhaling flavor component as a vapor phase. A *Nicotiana* raw material such as *Nicotiana. tabacum* or *Nicotiana. rusutica*, for example, may be used as the tobacco raw material 211. Varieties such as Burley and flue-cured, for example, may be used as the *Nicotiana. tabacum*. It is noted that tobacco raw materials of varieties other than Burley and flue-cured may also be used as the tobacco raw material 211.

The tobacco raw material 211 may be configured by a cut or powder and granular tobacco raw material. In this case, the particle diameter of the cut or powder and granular material is preferably 1.18 mm or less, so as to enlarge the specific surface area. Still more preferably, the particle diameter of the cut or powder and granular material is 0.5 mm or less. While there is no particular limitation as to the lower limit of the particle diameter of the cut or powder and granular material, a value of 0.212 mm or more is preferred.

It is noted that the initial content, in the dry state, of the inhaling flavor component (here, a nicotine component) contained in the tobacco raw material 211 is preferably 2.0 wt % or more, where the total weight of the tobacco raw material 211 is 100 wt %. The initial contained amount of the inhaling flavor component (in this case, the nicotine component) is preferably 4.0 wt % or more.

As mentioned above, the pH of the tobacco raw material 211 subsequent to alkali treatment is preferably 8.0 or more. Still more preferably, the pH of the tobacco raw material 211 subsequent to alkali treatment is within the range from 8.0 to 14.0, and preferably within the range from 8.5 to 11.0.

In the second example of the package, the tobacco raw material 211 may be placed in a breathable pouch or the like. In so doing, the cut or powder and granular tobacco raw material configuring the tobacco raw material 211 is not drawn through the holes in the partition plate 233 and into the space containing the inhaling flavor product 220.

(Third Example of Package)

Figure 13:
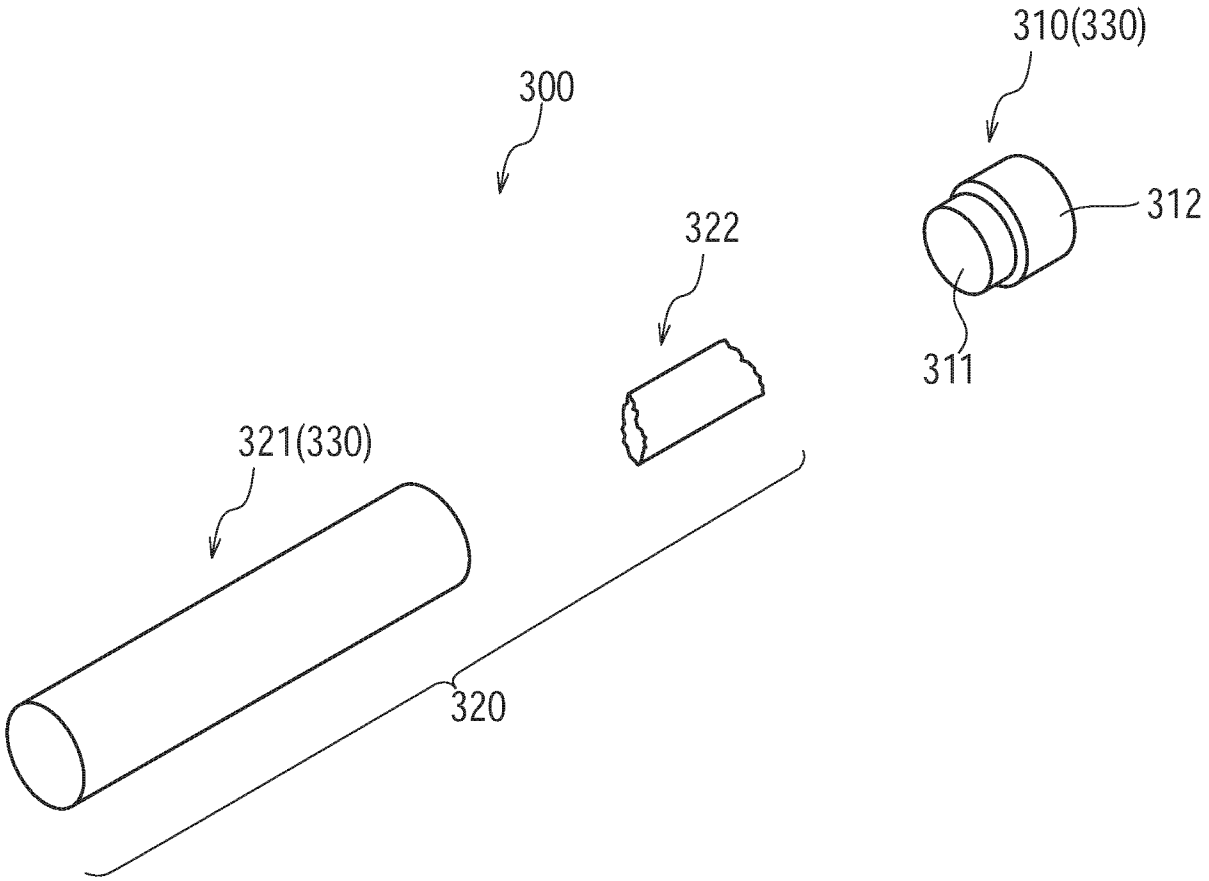
FIG. 13 is a diagram for describing a third example of the packaging according to the second embodiment.

A package according to a third example of the second embodiment will be described below. FIG. 13 is a diagram describing a package 300 according to the second embodiment.

As illustrated in FIG. 13, the package 300 is portable. The package 300 is a cartridge for use, for example, in a non-burning type flavor inhaler equipped with an atomizer or the like. The package 300 includes a lid body 310 and an inhaling flavor product 320.

The lid body 310 has a tobacco raw material 311 and a lid main body 312. The configuration of the tobacco raw material 311 is similar to that of the tobacco raw material 111. The tobacco raw material 311 has undergone an alkali treatment, and emits an inhaling flavor component as a vapor phase. The lid main body 312 retains the tobacco raw material 311.

The inhaling flavor product 320 has a cartridge main body 321 and a flavor base material 322. The cartridge main body 321 is a member having a cylindrical shape, for example, and retains the flavor base material 322. The flavor base material 322 is a member configured, for example, by a porous body such as a resin web or cotton, and contains at least one type of polyhydric alcohol. The polyhydric alcohol is glycerol, propylene glycol, or the like, for example. The flavor base material 322 captures the inhaling flavor component emitted as a vapor phase from the tobacco raw material 311.

In the third example of the package, the lid main body 312 and the cartridge main body 321 configure a container portion 330 for containing the tobacco raw material 311 and the flavor base material 322. The container portion 330 limits the movement of at least one of the tobacco raw material 311 and the flavor base material 322, so as to maintain the tobacco raw material 311 and the flavor base material 322 in a non-contacting state. The tobacco raw material 311 and the flavor base material 322 are arranged within the same space configured by the container portion 330 (the lid main body 312 and the cartridge main body 321).

Specifically, the tobacco raw material 311, while retained by the lid main body 312, is inserted into the cartridge main body 321, and is exposed within an inside space of the cartridge main body 321. Because the tobacco raw material 311 is retained by the lid main body 312, and the flavor base material 322 is retained by the cartridge main body 321, the tobacco raw material 311 and the flavor base material 322 are maintained in a non-contacting state.

It is preferable that the same space configured by the lid main body 312 and the cartridge main body 321 is a sealed space. A "sealed space" refers to a condition in which foreign matter is prevented from infiltrating in the course of normal handling (transport, storage, and the like). For example, one end of the cartridge main body 321 is closed off by the lid body 310, and the other end of the cartridge main body 321 is sealed by a seal member. In so doing, the inhaling flavor component contained in the tobacco raw material 311 is largely prevented from volatilization to the outside of the container portion 330 (the lid main body 312 and the cartridge main body 321).

It should be noted that in the third example of the package, the lid main body 312 is detached from the inhaling flavor product 320 at times of use of the inhaling flavor product 320. Times of use of the inhaling flavor product 320 refers to times at which the inhaling flavor product 320 is installed in a non-burning type flavor inhaler.

(Operation and Effect)

In the second embodiment, while the tobacco raw material 111 (the tobacco raw material 211 or the tobacco raw material 311) and the flavor base material 122 (the inhaling flavor product 220 or the flavor base material 322) are arranged within the same space configured by the container portion 130 (the case body 230 or the container portion 330), movement of at least one of the tobacco raw material 111 (the tobacco raw material 211 or the tobacco raw material 311) and the flavor base material 122 (the inhaling flavor product 220 or the flavor base material 322) is limited so that the tobacco raw material 111 (the tobacco raw material 211 or the tobacco raw material 311) and the flavor base material 122 (the inhaling flavor product 220 or the flavor base material 322) are maintained in a non-contacting state. Therefore, it is possible to induce the flavor base material 122 (the inhaling flavor product 220 or the flavor base material 322) to support easily and at low cost the inhaling flavor component contained in the tobacco raw material 111 (the tobacco raw material 211 or the tobacco raw material 311), while preventing transfer of contaminating components.

[Experiment Result]

(First Experiment)

In a first experiment, samples 1 to 4 were produced in accordance with the basic concept (See FIG. 3) of the method for producing a flavor source described above. However, step S30 (the storage process) was omitted. The compositions and weights of the tobacco raw materials and flavor base materials (gum bases) used in the samples 1 to 4 were as indicated in FIG. 14. Further, the conditions (the transfer temperature and the transfer time) that were implemented in step S20 shown in FIG. 3 (transfer step) were as indicated in FIG. 14. It is noted that the amount of raw material of the transfer source raw material employed in producing the samples 1 and 2 was 40 mg, and the amount of raw material of the transfer source raw material employed in producing the samples 3 and 4 was 80 mg.

Here, spherical gum bases having a diameter of 5 mm were used as the flavor base material for the samples 1 to 4. In the first experiment, the gum bases were divided into a surface layer portion and an inner portion, in such a way that the weight ratio of the surface layer portion and the inner portion was 1:1, and the inhaling flavor component (here, the amount of the nicotine component) in the surface layer portion and the inner portion was measured. The measurement results for the samples 1 and 2 are as indicated in FIG. 15, and the measurement results for the samples 3 and 4 are as indicated in FIG. 16.

As shown in FIG. 15, in the both samples 1 and 2, in which the transfer time was the same but the transfer temperatures were different, it was found that about 90% or more of the inhaling flavor component was contained in the surface layer portion. As shown in FIG. 16, in the both samples 3 and 4, in which the transfer temperature was the same but the transfer times were different, it was found that about 90% or more of the inhaling flavor component was contained in the surface layer portion.

That is, from the first experiment, it was found that the inhaling flavor component concentrates in the surface layer portion, irrespective of the transfer time and the transfer temperature. It was found that therefore, if a storage process (e.g., in the course of the product distribution process, or during storage at a production facility or retail outlet) was performed on the flavor base material while still in this state, the inhaling flavor component concentrated in the surface layer portion tends to volatilize. In other words, it was discovered that by performing the kneading process (step S22A) after performing the transfer process (step S20) as in the first example of the method for producing a flavor source described above (see FIG. 4), the inhaling flavor component that has transferred to the surface layer portion of the flavor base material becomes confined within the inside of the flavor base material, effectively preventing volatilization of the inhaling flavor component that has transferred to the surface layer portion of the flavor base material.

Further, because, due to the fact that the kneading process (step S22A) is performed after having performed the transfer process (step S20), and then a further transfer process (step S20) is performed, as in the second example of the method for producing a flavor source described above (see FIG. 5), the transfer process (step S20) takes place in a state in which the concentration of the inhaling flavor component contained in the surface layer portion of the flavor base material has been reduced due the kneading process (step S22A), and therefore the desired amount of the inhaling flavor component can be quickly transferred from the tobacco raw material to the flavor base material.

(Second Experiment)

In a second experiment, samples 11 and 12 were produced according to the basic concept of the method for producing a flavor source described above (see FIG. 3). However, step S30 (the storage process) was omitted. The compositions and weights of the tobacco raw materials and flavor base materials (capture solution supported on acetate filters) used in producing the samples 11 and 12 were as indicated in FIG. 17. Further, the conditions (the transfer temperature and the transfer time) implemented in step S20 (the transfer process) shown in FIG. 3 were as indicated in FIG. 17.

In the second experiment, the content of the inhaling flavor component (here, a nicotine component) in the samples 11 and 12 was measured after performing step S20 (the transfer process). The measurement results for the samples 11 and 12 are as shown in FIG. 18 and FIG. 19.

Figures 18, 19:
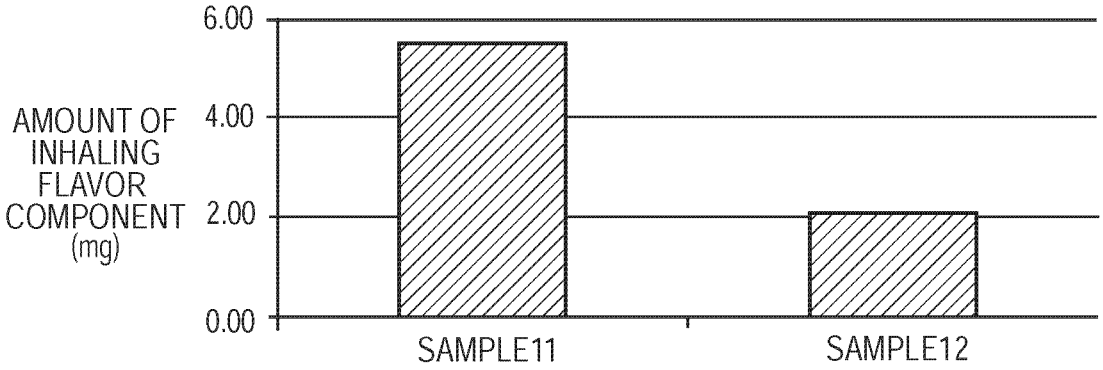
FIG. 18 is a diagram for describing the second experiment.
FIG. 19 is a diagram for describing the second experiment.

As shown in FIG. 18 and FIG. 19, it was found that the inhaling flavor component content of sample 11, in which the capture solvent supported on the acetate filter contained levulinic acid in addition of glycerol, was greater as compared with sample 12, in which the capture solvent supported on the acetate filter was configured by glycerol only.

That is, it was found that by adding an acidic substance (here, levulinic acid) to the capture solvent in the addition process (step S21B) of the third example of the method for producing a flavor source described above, re-volatilization of the inhaling flavor component (here, the nicotine component) already transferred to the capture solvent is prevented, and the inhaling flavor component (here, the nicotine component) supported on the flavor base material could be maintained.

(Third Experiment)

In a third experiment, simulating the third example of the method for producing a flavor source described above (see FIG. 6), samples 21-24 were produced by mixing nicotine (CAS: 54-11-5, purity: 99.5%) and other reagents. That is, for the sample 21 to sample 24, glycerol was used as the flavor base material (capture solvent). The amount of glycerol in the sample 21 was approximately 70 wt %, and the amount of glycerol in the samples 22 to 24 was approximately 90 wt %, where the capture solution after addition of the additives is 100 wt %. Further, in the samples 22-24, an acidic substance (here, levulinic acid) was added to the capture solvent. As shown in FIG. 20, the A/N ratio in the samples 22 to 24 were 0.53, 1.16, and 3.52, respectively. As mentioned above, the A/N ratio is the ratio of the molar quantity of the acidic substance (here, levulinic acid) added to the capture solvent, relative to the molar quantity of the inhaling flavor component (here, the nicotine component) captured by the capture solvent.

Figure 21:
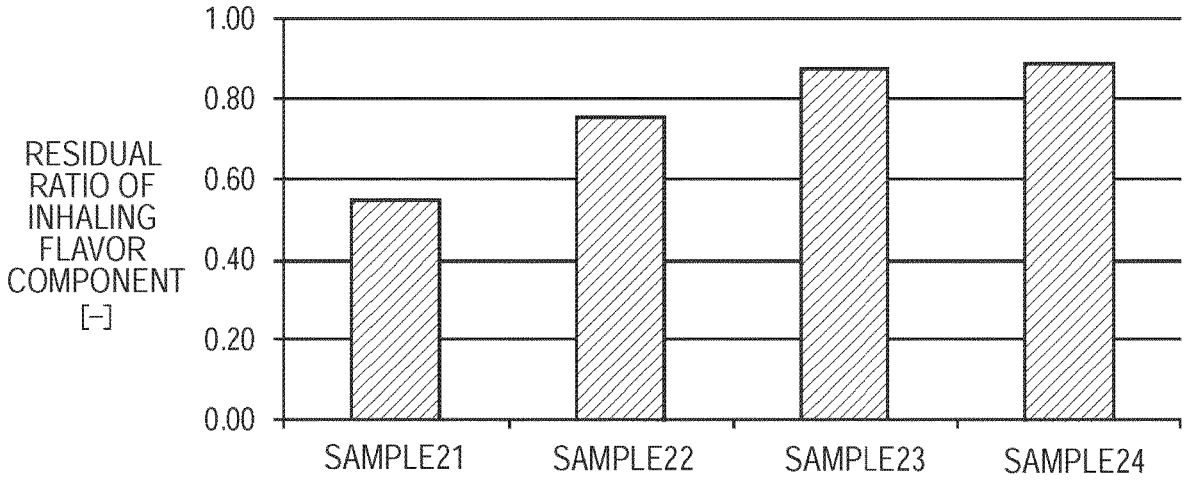
FIG. 21 is a diagram for describing the third experiment.
Figure 22:
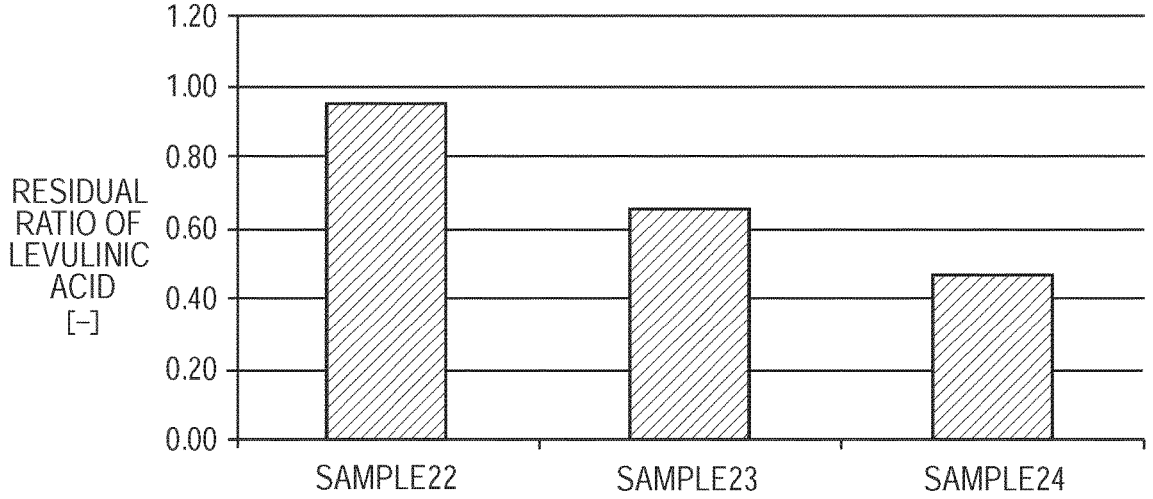
FIG. 22 is a diagram for describing the third experiment.

In the third experiment, by way of step S30 (storage process), the samples were stored under open space conditions for seven days, in an environment controlled to 40° C. For the samples 21 to 24, the ratio of the amount of the inhaling flavor component (here, the amount of the nicotine component) after performing storage under open space conditions to the amount of the inhaling flavor component (here, the amount of the nicotine component) prior to performing storage under open space conditions (the inhaling flavor component residual ratio) was measured. The measurement results are as shown in FIG. 20 and FIG. 21. For the samples 22 to 24, the ratio of the amount of levulinic acid after performing storage under open space conditions to the amount of levulinic acid prior to performing storage under open space conditions (the levulinic acid residual ratio) was measured. The measurement results are as shown in FIG. 20 and FIG. 22.

Here, in the third experiment, the inhaling flavor component residual ratio was determined to be sufficient when the inhaling flavor component residual ratio was 0.8 or more, and the levulinic acid residual ratio was determined to be sufficient when the levulinic acid residual ratio was 0.8 or more.

As shown in FIG. 21, it was found that the inhaling flavor component residual ratio of the samples 22 to 24 which contained levulinic acid was higher than that of the sample 21, which did not contain levulinic acid. In particular, for the sample 23 and the sample 24, which had A/N ratios of 1.0 or more, the inhaling flavor component residual ratio exceeded 0.8, and the inhaling flavor component residual ratio was found to be sufficient; whereas, considering the error of 0.03, for the sample 22, which had an A/N ratio of 0.5 or less, the inhaling flavor component residual ratio fell below 0.8, and the inhaling flavor component residual ratio was found to be insufficient. Meanwhile, as shown in FIG. 22 it was found that the levulinic acid residual ratio declines at higher A/N ratios. In particular, for the sample 23 and the sample 24, which had A/N ratios of 1.0 or more, the levulinic acid residual ratio fell below 0.8, and the inhaling flavor component residual ratio was found to be insufficient; whereas, considering the error of 0.03, for sample 22, which had an A/N ratio of 0.5 or less, the levulinic acid residual ratio fell below 0.8, and the levulinic acid residual ratio was found to be sufficient.

In other words, while the inhaling flavor component residual ratio was improved by the addition of an acidic substance (here, levulinic acid), considering the error of 0.03, for the sample 22, which had an A/N ratio of 0.5 or less, the inhaling flavor component residual ratio was insufficient, whereas for the samples 23 and 24, which had A/N ratios of 1.0 or more, the levulinic acid residual ratio was insufficient.

Here, it should be noted that because it is inferred that the decline in the levulinic acid residual ratio is due to the production of unwanted substances due to reasons such as esterification of the levulinic acid caused by reaction of the levulinic acid and the glycerol, it is preferable to avoid a decline in the levulinic acid residual ratio.

(Fourth Experiment)

In a fourth experiment, simulating the third example of the method for producing a flavor source described above (see FIG. 6), samples 31 to 33 were produced by mixing nicotine (CAS: 54-11-5, purity: 99.5%) and other reagents. For the sample 31 to the sample 33, glycerol was used as the flavor base material (capture solvent). The amount of glycerol in the sample 31 was approximately 90 wt %, and the amount of glycerol in the sample 32 and the sample 33 was approximately 80 wt %, where the capture solution after addition of the additives is 100 wt %. In the sample 31 to the sample 33, an acidic substance (here, levulinic acid) was added to the capture solvent. As shown in FIG. 23, the A/N ratios in the samples 31-33 were 0.53, 0.50, and 0.49, respectively. It should be noted that, considering the error of 0.03, the samples 31 to 33 were samples in which the A/N ratio was 0.5 or less. Here, in the sample 32, 10 wt % of propylene glycol was added to the capture solvent, and in the sample 33, 10 wt % of water was added to the capture solvent.

In the fourth experiment, by way of step S30 (storage process), storage was performed under open space conditions for seven days, in an environment controlled to 40° C. For the samples 31 to 33, the ratio of the amount of the inhaling flavor component (here, the nicotine component) after performing storage under open space conditions to the amount of inhaling flavor component (here, the nicotine component) prior to performing storage under open space conditions (the inhaling flavor component residual ratio) was measured. The measurement results are as shown in FIG. 23 and FIG. 24.

In the fourth experiment, when the inhaling flavor component residual ratio was 0.8 or more, the inhaling flavor component residual ratio was determined to be sufficient.

Figure 24:
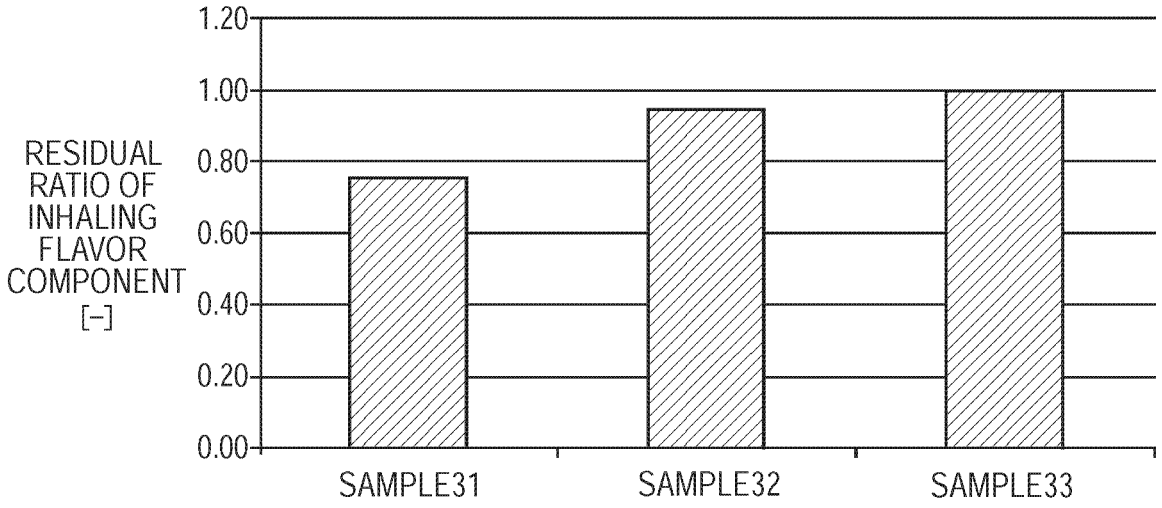
FIG. 24 is a diagram for describing the fourth experiment.

As shown in FIG. 24, for the sample 32 and the sample 33, to which 10 wt % of propylene glycol or water was added to the capture solvent, the inhaling flavor component residual ratio exceeded 8.0, and the inhaling flavor component residual ratio was found to be sufficient, whereas for sample 31, to which neither propylene glycol or water added, the inhaling flavor component residual ratio fell below 0.8, and the inhaling flavor component residual ratio was found to be insufficient. That is, in the third experiment, considering the error of 0.03, while samples for which the A/N ratio was 0.5 or less were found to have an insufficient inhaling flavor component residual ratio, it was also found that in such samples, the inhaling flavor component residual ratio was improved through the addition of 10 wt % or more of propylene glycol or water. It should be noted from the results of the third experiment that in a case where the A/N ratio is 0.5 or less, the levulinic acid residual ratio is sufficient.

In this way, it was found that in a case where the A/N ratio is 0.5 or less, by including 10 wt % or more of propylene glycol or 10 wt % or more of water in the capture solution, where the capture solution subsequent to addition of the additives (here, levulinic acid and propylene glycol, levulinic acid and water, levulinic acid, or propylene glycol and water) is 100 wt %, the inhaling flavor component residual ratio can be improved, while maintaining the levulinic acid residual ratio at a sufficient level.

It is inferred that similar results could be obtained by including a total of 10 wt % or more of a mixed solution of propylene glycol and water in a capture solution.

(Fifth Experiment)

In a fifth experiment, simulating the third example of the method for producing a flavor source described above (see FIG. 6), samples 41 to 44 were produced by mixing nicotine (CAS: 54-11-5, purity: 99.5%) and other reagents. For the sample 41 to the sample 44, glycerol was used as the flavor base material (capture solvent). The amount of glycerol in the sample 41 and the sample 43 was approximately 80 wt %, and the amount of glycerol in the sample 42 and the sample 44 was approximately 90 wt %, where the capture solution after addition of the additives is 100 wt %. In the sample 41 to the sample 44, an acidic substance (here, levulinic acid) was added to the capture solvent. As shown in FIG. 25, the A/N ratios in samples 41-43 were 2.99, 2.98, 1.56 and 1.62, respectively. It should be noted that the samples 41 to 44 are samples in which the A/N ratio is 1.0 or more. Here, in the sample 41 and the sample 43, 10 wt % of water was added to the capture solvent.

In the fifth experiment, by way of step S30 (storage process), storage was performed under sealed space conditions for four weeks, in an environment controlled to 40° C. For the samples 41 to 44, the ratio of the amount of levulinic acid after performing storage under sealed space conditions to the amount of levulinic acid prior to performing storage under sealed space conditions (the levulinic acid residual ratio) was measured. The measurement results are as shown in FIG. 25 and FIG. 26.

In the fifth experiment, if the levulinic acid residual ratio was 0.8 or more, the levulinic acid residual ratio was determined to be sufficient.

Figure 26:
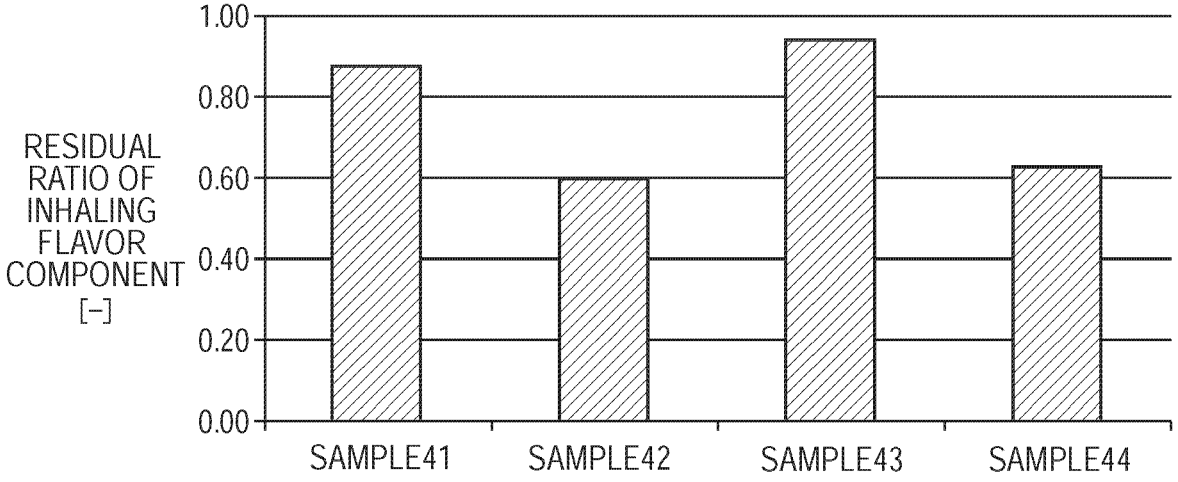
FIG. 26 is a diagram for describing the fifth experiment.

As shown in FIG. 26, in the sample 41 and the sample 43 in which 10 wt % of water was added to the capture solvent, the levulinic acid residual ratio exceeded 0.8, and the levulinic acid residual ratio was found to be sufficient, whereas in the sample 42 and the sample 44 to which no water was added, the levulinic acid residual ratio fell below 0.8, and the levulinic acid residual ratio was found to be insufficient. That is, in the third experiment, samples in which the A/N ratio was 1.0 or more were found to have a levulinic acid residual ratio that was insufficient, but for such samples, it was found that the levulinic acid residual ratio was improved by the addition of 10 wt % or more of water. It should be noted that from the results of the third experiment, it should be noted that cases in which the A/N ratio is 1.0 or more, the inhaling flavor component residual ratio is insufficient.

In this way, it was found that in a case where the A/N ratio is 1.0 or more, by including 10 wt % or more of water in the capture solution, where the capture solution subsequent to addition of the additives (here, levulinic acid and water) is 100 wt %, the levulinic acid residual ratio can be improved, while maintaining the inhaling flavor component residual ratio at a sufficient level.

(Sixth Experiment)

In a sixth experiment, simulating the third example of the method for producing a flavor source described above (see FIG. 6), samples 51 to 53 were produced by mixing nicotine (CAS: 54-11-5, purity: 99.5%) and other reagents. For the sample 51 to the sample 53, glycerol was used as the flavor base material (capture solvent). The amount of glycerol in the sample 51 to the sample 53 was approximately 90 wt %, where the capture solution after addition of the additives is 100 wt %. Further, in the sample 51 to the sample 53, an acidic substance (here, formic acid) was added to the capture solvent. As shown in FIG. 27, the A/N ratios in the samples 51 to 53 were 0.60, 0.61, and 0.60, respectively. It should be noted that the samples 51 to 53 are samples in which the A/N ratio is greater than 0.5 but less than 1.0.

Figure 28:
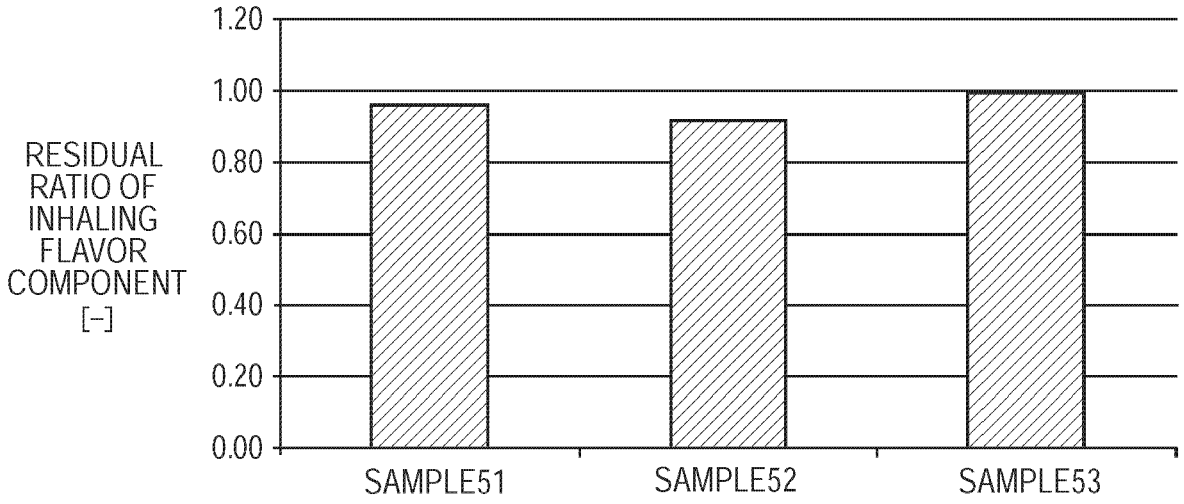
FIG. 28 is a diagram for describing the sixth experiment.
Figure 29:
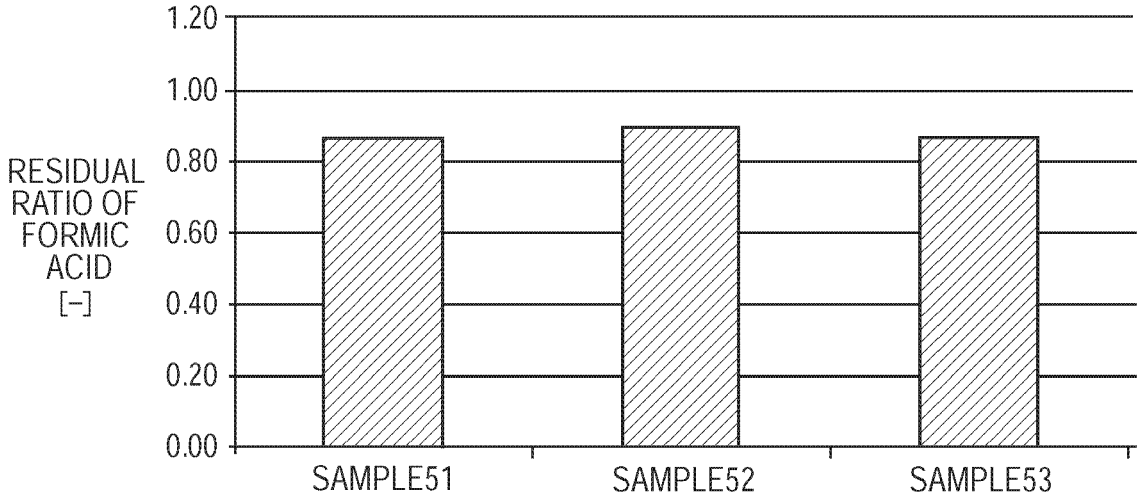
FIG. 29 is a diagram for describing the sixth experiment.

In the sixth experiment, by way of step S30 (storage process), storage was performed under open space conditions for seven days, in an environment controlled to 40° C. For the samples 51 to 53, the ratio of the amount of the inhaling flavor component (here, the nicotine component) after performing storage under open space conditions to the amount of inhaling flavor component (here, the nicotine component) prior to performing storage under open space conditions (the inhaling flavor component residual ratio) was measured. The measurement results are as shown in FIG. 27 and FIG. 28. For the samples 51 to 53, the ratio of the amount of formic acid after performing storage under open space conditions to the amount of formic acid prior to performing storage under open space conditions (the formic acid residual ratio) was measured. The measurement results are as shown in FIG. 27 and FIG. 29.

Here, in the sixth experiment, the inhaling flavor component residual ratio was determined to be sufficient when the inhaling flavor component residual ratio was 0.8 or more, and the formic acid residual ratio was determined to be sufficient when the formic acid residual ratio was 0.8 or more.

As shown in FIG. 28, in the samples 51 to 53, in which the A/N ratio was greater than 0.5 but less than 1.0, the inhaling flavor component residual ratio exceeded 0.8, and the inhaling flavor component was found to be sufficient. Further, as shown in FIG. 29, in the samples 51-53, in which the A/N ratio was greater than 0.5 but less than 1.0, the formic acid residual ratio exceeded 0.8, and the formic acid residual ratio was found to be sufficient. That is, in the third experiment, considering the error of 0.03, in samples for which the A/N ratio was 0.5 or less, the inhaling flavor component residual ratio was found to be insufficient, and in samples in which the A/N was 1.0 or more, the levulinic acid residual ratio was found to be insufficient, but it was found that when the A/N ratio was greater than 0.5 but less than 1.0, the inhaling flavor component residual ratio and the formic acid residual ratio were sufficient, even when propylene glycol or water was not added to the capture solvent.

In this way, it was found that in a case where an acidic substance such as a carboxylic acid is added to a capture solvent, it is preferable for the A/N ratio to be greater than 0.5 but less than 1.0.

[Measurement Method]

(Measurement Method of Nicotine Component Supported on Gum Base or Acetate Filter)

Firstly, the entire amount of a sample is introduced into a 50 ml screw vial, 15 ml of 11% sodium hydroxide aqueous solution is introduced, and then, 20 ml of a mixed solution of 1000 ml of n-hexane and 500 mg of n-heptadecane is introduced.

Secondly, the above-described screw vial is shielded from light by using aluminium foil, and then shaken for 18 hours.

Thirdly, the shaken screw vial is left to rest for about one hour.

Fourthly, the supernatant is collected, filtered by using a 0.45 μm membrane filter, and then analyzed by a gas chromatography mass spectrometer (GCMS).

(Measurement Method of Nicotine Component Supported by Capture Solvent)

Measurement is performed using a method in accordance with the German Institute for Standardization, DIN 10373. That is, 100 mm of the capture solvent in which the inhaling flavor component was captured was collected, 7.5 mL of an 11% sodium hydroxide aqueous solution and 10 mL of hexane were added, and the nicotine was transferred to the hexane phase by shaking extraction for 60 minutes. After the extraction, a hexane phase, which configured the supernatant, was supplied to a gas chromatography mass spectrometer (GC/MS), and the nicotine weight included in the tobacco raw material was quantitatively measured.

(Measurement Method of Carboxylic Acid Added to Capture Solution)

An analysis was performed by the following method. That is, 20 mg of the capture solution targeted for analysis was collected, 10 mL of purified water was added, and shaking extraction was performed for 30 minutes. Next, the shaken solution was filtered through a 0.45 μm membrane filter, and then analyzed by a capillary-electrophoretic system to quantify the weight of the carboxylic acid (levulinic acid or formic acid) added to the capture solution.

Other Embodiments

The present invention was described in terms of the embodiment set forth above, the invention should not be understood to be limited by the statements and the drawings configuring part of this disclosure. From this disclosure, various alternative embodiments, examples, and operational technologies will be obvious to those skilled in the art.

In the embodiment, there were many described cases in which the flavor base material is a member of solid form, or a liquid impregnating a solid. However, the embodiment is not limited thereto. Specifically, the flavor base material may be a capture solvent itself. As stated above, such a capture solvent could be, for example, a capture solvent that is contained in a cartridge for an electronic cigarette.

In the embodiment, step S21B (the addition process) was performed prior to step S20 (the transfer process), but the embodiment is not limited thereto. In a mode in which the capture solvent is not heated during step S20 (the transfer process), as in the third example of the method for producing a flavor source described above, i.e., a mode in which there is no volatilization of the additives (acidic substances such as carboxylic acids, water, or propylene glycol) added to the capture solvent, there are no particular limitations as to the timing for adding the additives. However, as shown in the second experiment, from the standpoint of maintaining the inhaling flavor component (here, the nicotine component) in step S20 (the transfer process), it is preferable for the addition process of the carboxylic acid or other acidic substance to be performed before step S20 (the transfer process). On the other hand, in a mode in which the capture solvent is heated during step S20 (the transfer process), in order to prevent volatilization of additives (acidic substances such as carboxylic acids, water, or propylene glycol) added to the capture solvent, it is preferable for step S21B (the addition process) to be performed prior to step S20 (the transfer process). However, it should be noted that in a case where acidic substances added to the capture solvent are substances that are not readily volatilized (e.g., citric acid, malic acid, or tartaric acid), even in a mode in which the capture solvent is heated, the acidic substance addition process can be performed prior to step S20 (the transfer process).

In the embodiment, step S21B (the addition process) was performed prior to step S20 (the transfer process), but the embodiment is not limited thereto. It should be noted that in a mode in which water or an acidic substance such as a carboxylic acid is added as an addition treatment to the capture solvent, a phenomenon whereby moisture or an acidic substance such as a carboxylic acid contained in the tobacco raw material (e.g., formic acid, acetic acid, or the like contained in the tobacco raw material) is transferred to the capture solvent in step S20 (the transfer process) is also encompassed within the concept of step S21B (the addition step). Further, in step S21B (the addition process), it would of course be acceptable to further add water or an acidic substance such as a carboxylic acid, in addition to water or an acidic substance such as a carboxylic acid that has transferred from the tobacco raw material to the capture solvent.

It should be noted that in the embodiment, the capture solvent after the inhaling flavor component has been captured therein is referred to as a capture solution. Therefore, in a case where the process to add to the capture solvent additives such as carboxylic acids, water, or propylene glycol is performed after the inhaling flavor component has been captured by the capture solvent, the process to added the additives to the capture solvent may be understood a a process to add the additives to the capture solution.

INDUSTRIAL APPLICABILITY

According to the embodiments, it is possible to provide a method for producing a flavor source and a package, by which is it possible to induce a flavor base material to support easily and at low cost an inhaling flavor component contained in tobacco raw material, while preventing transfer of contaminating components.

The invention claimed is:

1. A method for producing a flavor source that supports an inhaling flavor component contained in a tobacco raw material, the method comprising the steps of:

performing an alkali treatment on the tobacco raw material; and arranging an alkali-treated tobacco raw material and a flavor base material configured by non-tobacco material within a same space in such a way that the alkali-treated tobacco raw material and the flavor base material are maintained in a non-contacting state, thereby inducing the flavor base material to support the inhaling flavor component emitted as a vapor phase from the tobacco raw material, wherein the flavor base material is a capture solvent, and the method further includes the step of adding a carboxylic acid to the capture solvent.

2. The method for producing a flavor source according to claim 1, wherein the flavor base material is a member of solid form, or a liquid impregnated into a solid.

3. The method for producing a flavor source according to claim 1, wherein the ratio of a molar quantity of the carboxylic acid added to the capture solvent, relative to a molar quantity of the inhaling flavor component captured by the capture solvent, is greater than 0.5 and less than 1.0.

4. The method for producing a flavor source according to claim 1, wherein a capture solution includes 10 wt % or more of water where the capture solution containing at least the inhaling flavor component, the carboxylic acid and a capture solvent is 100 wt %, in a case where a ratio of the molar quantity of the carboxylic acid added to the capture solvent, relative to the molar quantity of the inhaling flavor component captured by the capture solvent, is 1.0 or more.

5. The method for producing a flavor source according to claim 4, wherein the step of arranging further includes: heating the alkali-treated tobacco raw material while arranged in the same space, the method further includes the step of adding water to the capture solvent or to the capture solution, in a case where the ratio of the molar quantity of the carboxylic acid added to the capture solvent, relative to the molar quantity of the inhaling flavor component captured by the capture solvent, is 1.0 or more, and the step of adding water is performed such that the capture solution includes 10 wt % or more of water, where the capture solution is 100 wt %.

6. The method for producing a flavor source according to claim 1, wherein the capture solution includes 10 wt % or more of propylene glycol, 10 wt % or more of water, or a total of 10 wt % or more of a mixed solution of propylene glycol and water where the capture solvent including at least the inhaling flavor component, the carboxylic acid and the capture solvent is 100 wt %, in a case where the ratio of the molar quantity of the carboxylic acid added to the capture solvent, relative to the molar quantity of the inhaling flavor component captured by the capture solvent, is 0.5 or less.

7. The method for producing a flavor source according to claim 6, wherein the step of arranging further includes: heating the alkali-treated tobacco raw material while arranged in the same space, the method further includes the step of adding propylene glycol, water, or a mixed solution of propylene glycol and water, to the capture solvent or to the capture solution, in a case where the ratio of the molar quantity of the carboxylic acid added to the capture solvent, relative to the molar quantity of the inhaling flavor component captured by the capture solvent, is 0.5 or less, and the step of adding propylene glycol, water or the mixed solution is performed such that the capture solution includes 10 wt % or more of propylene glycol, 10 wt % or more of water, or a total of 10 wt % or more of the mixed solution, where the capture solution is 100 wt %.

8. The method for producing a flavor source according to claim 5, wherein the step of adding water is performed after the step of arranging in a case where the capture solvent is heated together with the alkali-treated tobacco raw material in the step of arranging.

9. The method for producing a flavor source according to claim 1, wherein the step of arranging further includes heating at least the alkali-treated tobacco raw material.

10. The method for producing a flavor source according claim 1, wherein the flavor base material is a member of solid form, and the method further includes the step of kneading the flavor base material.

11. The method for producing a flavor source according to claim 10, further comprising the step of molding the flavor base material after the step of kneading.

* * * * *